US011208876B2

(12) United States Patent
Eslinger et al.

(10) Patent No.: US 11,208,876 B2
(45) Date of Patent: Dec. 28, 2021

(54) DYNAMIC ARTIFICIAL LIFT

(71) Applicant: Sensia LLC, Houston, TX (US)

(72) Inventors: David Milton Eslinger, Collinsville, OK (US); Emmanuel Coste, Houston, TX (US); Jeffery P. Anderson, Beaumont (CA)

(73) Assignee: Sensia LLC, Houston, TX (US)

( * ) Notice: Subject to any disclaimer, the term of this patent is extended or adjusted under 35 U.S.C. 154(b) by 180 days.

(21) Appl. No.: 16/491,856

(22) PCT Filed: Mar. 8, 2018

(86) PCT No.: PCT/US2018/021429
§ 371 (c)(1),
(2) Date: Sep. 6, 2019

(87) PCT Pub. No.: WO2018/165352
PCT Pub. Date: Sep. 13, 2018

(65) Prior Publication Data

US 2021/0140290 A1 May 13, 2021

Related U.S. Application Data

(60) Provisional application No. 62/468,708, filed on Mar. 8, 2017.

(51) Int. Cl.
*E21B 43/12* (2006.01)
*F04D 13/10* (2006.01)
*E21B 47/008* (2012.01)

(52) U.S. Cl.
CPC ..... *E21B 43/128* (2013.01); *E21B 43/12* (2013.01); *E21B 47/008* (2020.05); *F04D 13/10* (2013.01); *E21B 2200/22* (2020.05)

(58) Field of Classification Search
CPC ..... E21B 43/12; E21B 43/121; E21B 47/008; E21B 47/009; E21B 2200/22
See application file for complete search history.

(56) References Cited

U.S. PATENT DOCUMENTS 7,979,240 B2 * 7/2011 Fielder ..... F04D 13/10 702/185
2007/0179768 A1 * 8/2007 Cullick ..... E21B 43/00 703/10
2008/0262736 A1 10/2008 Thigpen et al.
2014/0244552 A1 8/2014 Liu et al.
(Continued)

FOREIGN PATENT DOCUMENTS

EP 1 279 794 A1 1/2003

OTHER PUBLICATIONS

EP Foreign Supplementary Search Report on EP Appl. Ser. No. 18763117.1 dated Nov. 26, 2020 (3 pages).

*Primary Examiner* — Tara Schimpf
(74) *Attorney, Agent, or Firm* — Foley & Lardner LLP

(57) ABSTRACT

A system includes a reception interface that receives sensor data of an artificial lift system disposed at least in part in a well; an analysis engine that, based at least in part on a portion of the sensor data, outputs values of state variables of the artificial lift system; and a transmitter interface that transmits information, based at least in part on a portion of the values of state variables, to a surface controller operatively coupled to the artificial lift system.

18 Claims, 16 Drawing Sheets

(56) References Cited

U.S. PATENT DOCUMENTS

| | | | | |
|---|---|---|---|---|
| 2015/0148919 | A1 | 5/2015 | Watson | |
| 2017/0286572 | A1* | 10/2017 | Hershey | G05B 23/0283 |
| 2017/0351959 | A1* | 12/2017 | Rasheed | E21B 44/00 |
| 2018/0340411 | A1* | 11/2018 | Munda | E21B 47/008 |
| 2018/0347298 | A1* | 12/2018 | Xue | E21B 21/01 |

* cited by examiner

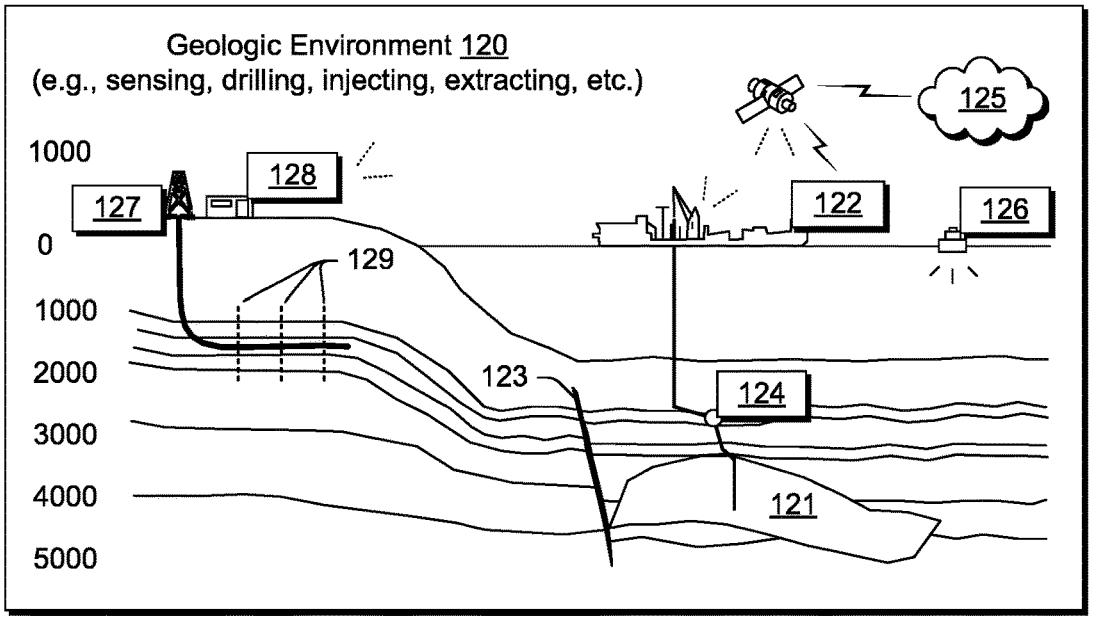
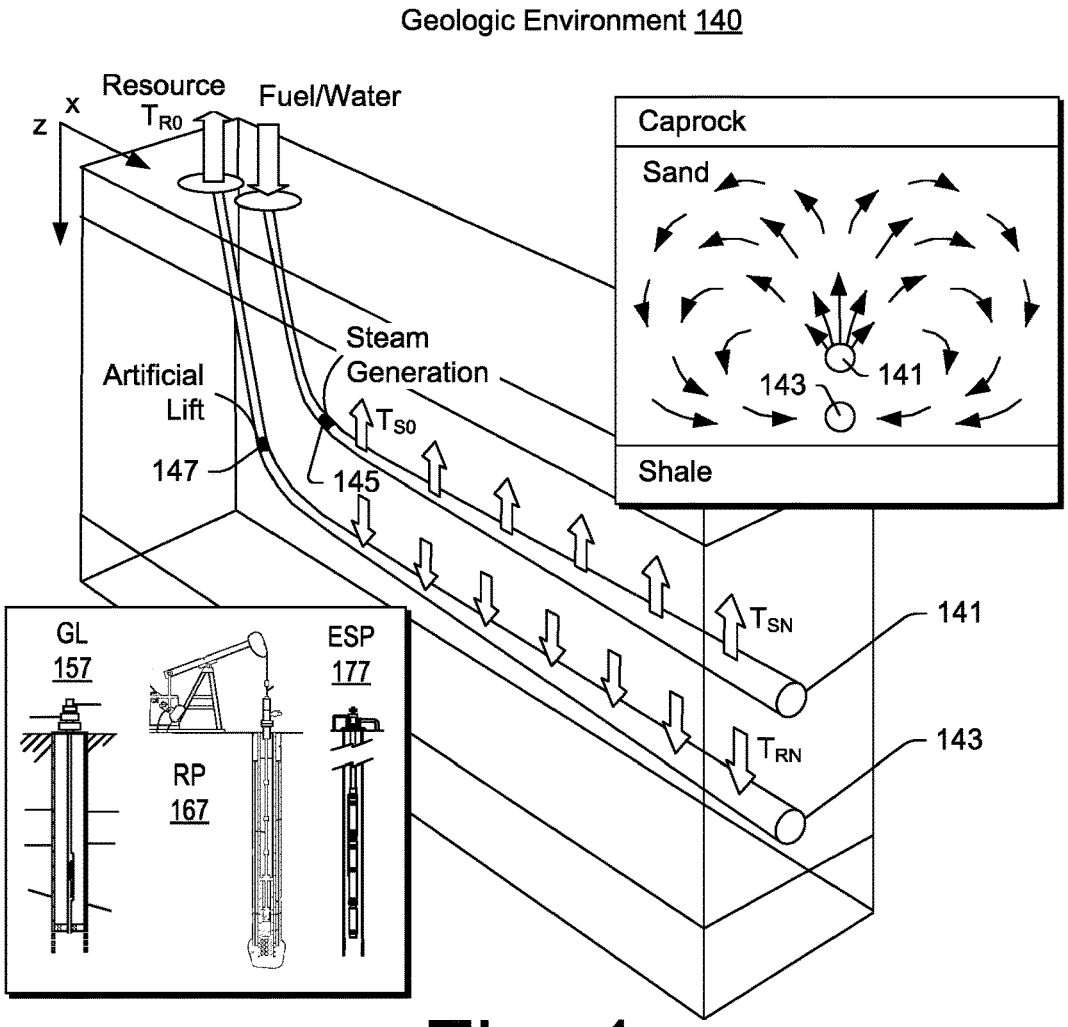
Fig. 1

Table 1000

| Physical behavior | Sensor measurements | Variables | Model Equation (Model) |
|---|---|---|---|
| • Tubing viscous pressure drop<br>• Gravitational head | $P_{wellhead} - P_{discharge}$ | • Density, viscosity, flowrate<br>• Density | • Darcy- Weisbach (Well Hydraulics) |
| • Pump temperature rise, $\Delta T$ | $T_{discharge} - T_{intake}$ | • Density, flowrate, heat capacity, and pump efficiency; pump efficiency is a function of fluid viscosity, flowrate, and pump leakage. | • Pump power loss = $\rho Q Cp \Delta T$ |
| • Pump pressure rise | $P_{discharge} - P_{intake}$ | • Density, viscosity, flowrate, and pump leakage. | • Manufacturer catalog data, Hydraulic Institute viscosity corrections (Pump) |
| • Tubing filling | Fluid arrival time at the wellhead during startup | • Flowrate | • $\sum$ dQ dt during startup (Well Hydraulics) |
| • Motor heat dissipation to annulus fluid | Motor oil temperature | • Density, flowrate, heat capacity, thermal conductivity, and viscosity | • Nusselt, Prandtl, Rayleigh, and Reynold's numbers (Motor Thermal) |

Fig. 10

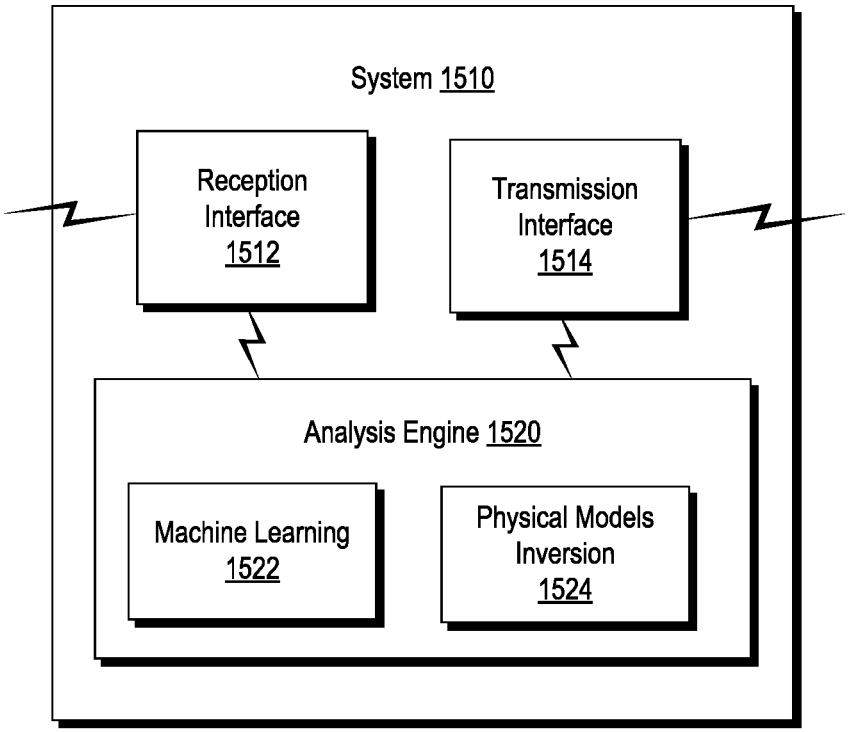
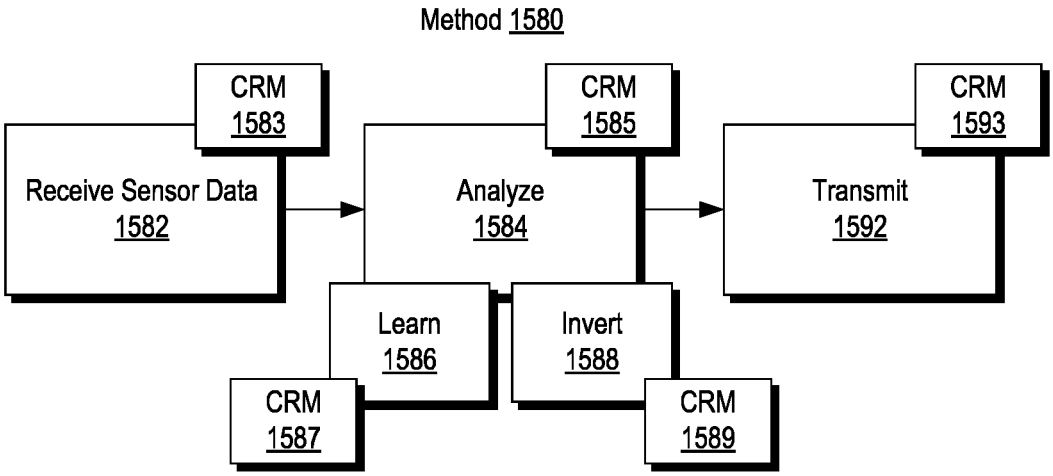
Fig. 15

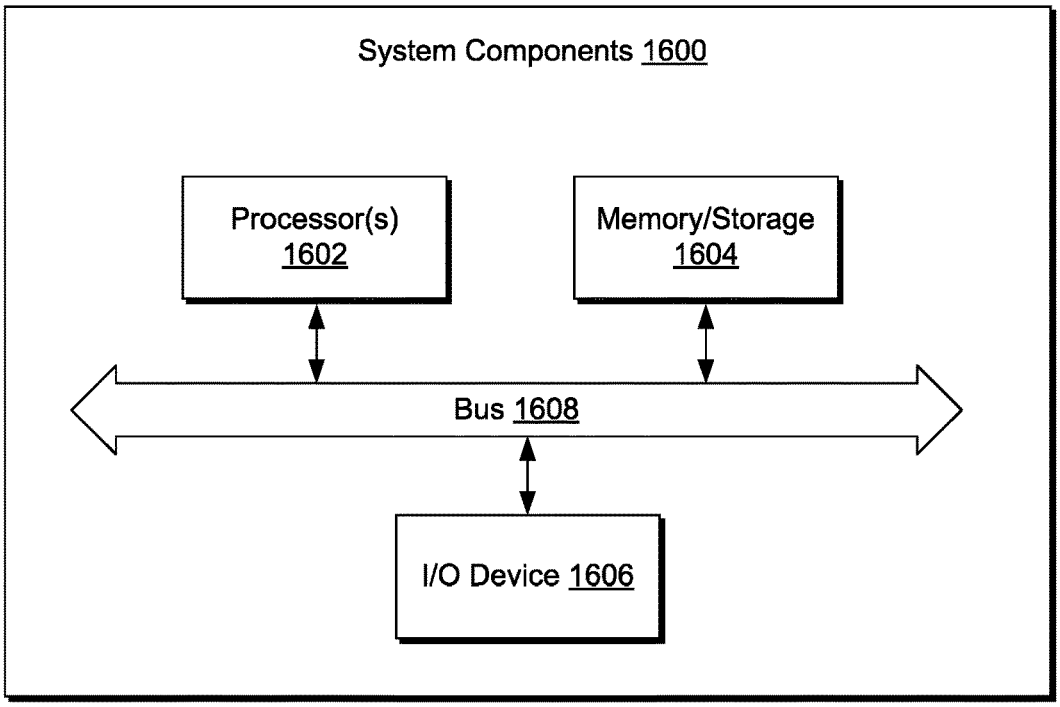
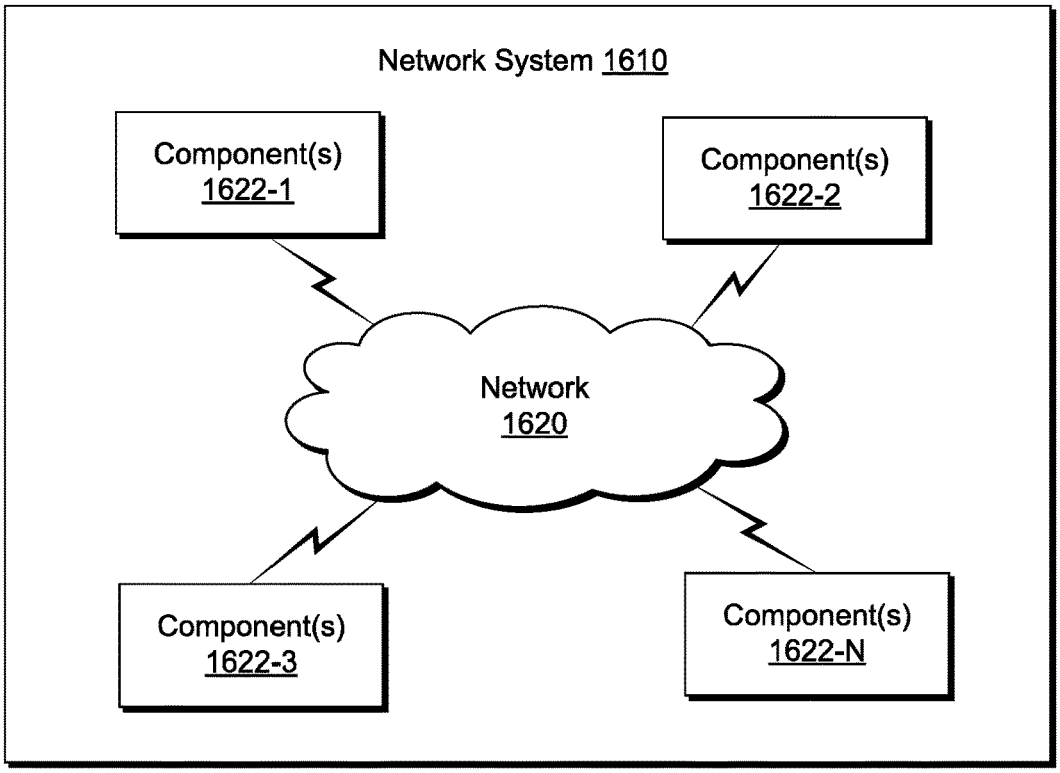
Fig. 16

DYNAMIC ARTIFICIAL LIFT

RELATED APPLICATIONS

This application claims priority to and the benefit of a U.S. Provisional Application having Ser. No. 62/468,708, filed 8 Mar. 2017, which is incorporated by reference herein.

BACKGROUND

Artificial lift technology can add energy to fluid to enhance production of the fluid. Artificial lift systems can include rod pumping systems, gas lift systems and electric submersible pump (ESP) systems. As an example, an artificial lift pumping system can utilize a surface power source to drive a downhole pump assembly. As an example, a beam and crank assembly may be utilized to create reciprocating motion in a sucker-rod string that connects to a downhole pump assembly. In such an example, the pump can include a plunger and valve assembly that converts the reciprocating motion to fluid movement (e.g., lifting the fluid against gravity, etc.). As an example, an artificial lift gas lift system can provide for injection of gas into production tubing to reduce the hydrostatic pressure of a fluid column. In such an example, a resulting reduction in pressure can allow reservoir fluid to enter a wellbore at a higher flow rate. A gas lift system can provide for conveying injection gas down a tubing-casing annulus where it can enter a production train through one or more gas-lift valves (e.g., a series of gas-lift valves, etc.). As an example, an electric submersible pump (ESP) can include a stack of impeller and diffuser stages where the impellers are operatively coupled to a shaft driven by an electric motor. As an example, an electric submersible pump (ESP) can include a piston that is operatively coupled to a shaft driven by an electric motor, for example, where at least a portion of the shaft may include one or more magnets and form part of the electric motor.

SUMMARY

A system can include a reception interface that receives sensor data of an artificial lift system disposed at least in part in a well; an analysis engine that, based at least in part on a portion of the sensor data, outputs values of state variables of the artificial lift system; and a transmitter interface that transmits information, based at least in part on a portion of the values of state variables, to a surface controller operatively coupled to the artificial lift system. A method can include receiving sensor data of an artificial lift system disposed at least in part in a well during operation of the artificial lift system; analyzing at least a portion of the sensor data to output values of state variables of the artificial lift system; and transmitting information, based at least in part on a portion of the values of state variables, to a surface controller operatively coupled to the artificial lift system. One or more computer-readable storage media can include computer-executable instructions executable to instruct a computing system to: receive sensor data of an artificial lift system disposed at least in part in a well during operation of the artificial lift system; analyze at least a portion of the sensor data to output values of state variables of the artificial lift system; and transmit information, based at least in part on a portion of the values of state variables, to a surface controller operatively coupled to the artificial lift system. Various other systems, methods, instructions, etc. are also disclosed.

This summary is provided to introduce a selection of concepts that are further described below in the detailed description. This summary is not intended to identify key or essential features of the claimed subject matter, nor is it intended to be used as an aid in limiting the scope of the claimed subject matter.

BRIEF DESCRIPTION OF THE DRAWINGS

Features and advantages of the described implementations can be more readily understood by reference to the following description taken in conjunction with the accompanying drawings.

FIG. 1 illustrates examples of equipment in geologic environments;

FIG. 10 illustrates an example of a table that includes examples of sensor measurements;

FIG. 15 illustrates an example of a system and an example of a method; and

FIG. 16 illustrates example components of a system and a networked system.

DETAILED DESCRIPTION

Figure 2:
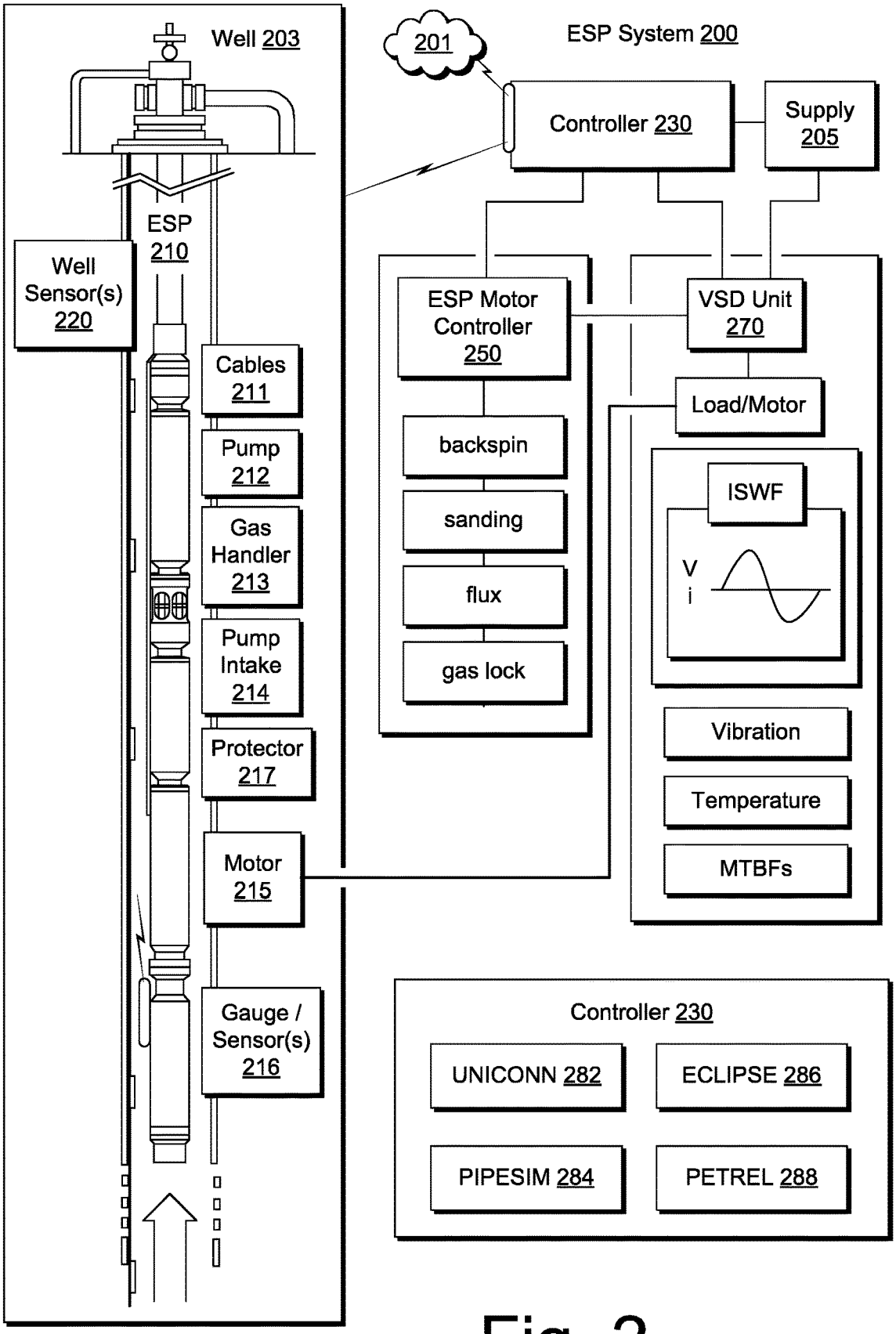
FIG. 2 illustrates an example of an electric submersible pump system.

The following description includes the best mode presently contemplated for practicing the described implementations. This description is not to be taken in a limiting sense, but rather is made merely for the purpose of describing the general principles of the implementations. The scope of the described implementations should be ascertained with reference to the issued claims.

As mentioned, artificial lift technology can add energy to fluid to enhance production of the fluid. Artificial lift systems can include rod pumping (RP) systems, gas lift (GL) systems and electric submersible pump (ESP) systems. As an example, an artificial lift pumping system can utilize a surface power source to drive a downhole pump assembly. As an example, a beam and crank assembly may be utilized to create reciprocating motion in a sucker-rod string that connects to a downhole pump assembly. In such an example, the pump can include a plunger and valve assembly that converts the reciprocating motion to fluid movement (e.g., lifting the fluid against gravity, etc.).

As an example, an artificial lift gas lift system can provide for injection of gas into production tubing to reduce the hydrostatic pressure of a fluid column. In such an example, a resulting reduction in pressure can allow reservoir fluid to enter a wellbore at a higher flow rate. A gas lift system can provide for conveying injection gas down a tubing-casing annulus where it can enter a production train through one or more gas lift valves (e.g., a series of gas lift valves, etc.). A gas lift valve position, operating pressures and gas injection rate can be determined by specific well conditions.

As an example, an electric submersible pump (ESP) can include a stack of impeller and diffuser stages where the impellers are operatively coupled to a shaft driven by an electric motor. As an example, an electric submersible pump (ESP) can include a piston that is operatively coupled to a shaft driven by an electric motor, for example, where at least a portion of the shaft may include one or more magnets and form part of the electric motor. As an example, an ESP may be equipped with a rotating shaft driven by an electric motor or an ESP may be equipped with a reciprocating shaft driven by an electric motor (e.g., linear permanent magnet motor, etc.).

FIG. 1 shows examples of geologic environments 120 and 140. In FIG. 1, the geologic environment 120 may be a sedimentary basin that includes layers (e.g., stratification) that include a reservoir 121 and that may be, for example, intersected by a fault 123 (e.g., or faults). As an example, the geologic environment 120 may be outfitted with any of a variety of sensors, detectors, actuators, etc. For example, equipment 122 may include communication circuitry to receive and to transmit information with respect to one or more networks 125. Such information may include information associated with downhole equipment 124, which may be equipment to acquire information, to assist with resource recovery, etc. Other equipment 126 may be located remote from a well site and include sensing, detecting, emitting or other circuitry. Such equipment may include storage and communication circuitry to store and to communicate data, instructions, etc. As an example, one or more satellites may be provided for purposes of communications, data acquisition, etc. For example, FIG. 1 shows a satellite in communication with the network 125 that may be configured for communications, noting that the satellite may additionally or alternatively include circuitry for imagery (e.g., spatial, spectral, temporal, radiometric, etc.).

FIG. 1 also shows the geologic environment 120 as optionally including equipment 127 and 128 associated with a well that includes a substantially horizontal portion that may intersect with one or more fractures 129. For example, consider a well in a shale formation that may include natural fractures, artificial fractures (e.g., hydraulic fractures) or a combination of natural and artificial fractures. As an example, a well may be drilled for a reservoir that is laterally extensive. In such an example, lateral variations in properties, stresses, etc. may exist where an assessment of such variations may assist with planning, operations, etc. to develop the reservoir (e.g., via fracturing, injecting, extracting, etc.). As an example, the equipment 127 and/or 128 may include components, a system, systems, etc. for fracturing, seismic sensing, analysis of seismic data, assessment of one or more fractures, etc.

As to the geologic environment 140, as shown in FIG. 1, it includes two wells 141 and 143 (e.g., bores), which may be, for example, disposed at least partially in a layer such as a sand layer disposed between caprock and shale. As an example, the geologic environment 140 may be outfitted with equipment 145, which may be, for example, steam assisted gravity drainage (SAGD) equipment for injecting steam for enhancing extraction of a resource from a reservoir. SAGD is a technique that involves subterranean delivery of steam to enhance flow of heavy oil, bitumen, etc. SAGD can be applied for Enhanced Oil Recovery (EOR), which is also known as tertiary recovery because it changes properties of oil in situ.

As an example, a SAGD operation in the geologic environment 140 may use the well 141 for steam-injection and the well 143 for resource production. In such an example, the equipment 145 may be a downhole steam generator and the equipment 147 may be an electric submersible pump (e.g., an ESP).

FIG. 1 also shows various examples of artificial lift equipment including a gas lift (GL) system 157, a rod pumping (RP) system 167, and an ESP system 177. Such equipment may be disposed at least in part in a downhole environment to facilitate production of fluid; noting that a pump system (e.g., RP and/or ESP) may be utilized to move fluid to a location other than a surface location (e.g., consider injection to inject fluid into a subterranean region, etc.). A gas lift system operates at least in part on buoyancy as injected gas may be expected to rise due to buoyancy in a direction that is opposite gravity; whereas, a RP or an ESP may operate via mechanical movement of physical components to drive fluid in a desired direction, which may be with or against gravity.

As illustrated in a cross-sectional view of FIG. 1, as to SAGD as an enhanced recovery technique, steam is injected via the well 141 where the steam may rise in a subterranean portion of the geologic environment and transfer heat to a desirable resource such as heavy oil. In turn, as the resource is heated, its viscosity decreases, allowing it to flow more readily to the well 143 (e.g., a resource production well). In such an example, equipment 147 (e.g., an ESP) may then assist with lifting the resource in the well 143 to, for example, a surface facility (e.g., via a wellhead, etc.). As an example, where a production well includes artificial lift equipment such as an ESP, operation of such equipment may be impacted by the presence of condensed steam (e.g., water in addition to a desired resource). In such an example, an ESP may experience conditions that may depend in part on operation of other equipment (e.g., steam injection, operation of another ESP, etc.). While an ESP is mentioned, GL equipment and/or RP equipment may experience conditions that may depend in part on operation of other equipment. As an example, one or more technologies may be implemented to enhance recovery of fluid, inject fluid, etc.

Conditions in a geologic environment may be transient and/or persistent. Where equipment is placed within a geologic environment, longevity of the equipment can depend on characteristics of the environment and, for example, duration of use of the equipment as well as function of the equipment. Where equipment is to endure in an environment over an extended period of time, uncertainty may arise in one or more factors that could impact integrity or expected lifetime of the equipment. As an example, where a period of time may be of the order of decades, equipment that is intended to last for such a period of time may be constructed to endure conditions imposed thereon, whether imposed by an environment or environments and/or one or more functions of the equipment itself.

FIG. 2 shows an example of an ESP system 200 that includes an ESP 210 as an example of equipment that may be placed in a geologic environment. As an example, an ESP may be expected to function in an environment over an extended period of time (e.g., optionally of the order of years). As an example, commercially available ESPs (such as the REDA™ ESPs marketed by Schlumberger Limited, Houston, Tex.) may find use in applications that call for, for example, pump rates in excess of about 4,000 barrels per day and lift of about 12,000 feet or more.

In the example of FIG. 2, the ESP system 200 includes a network 201, a well 203 disposed in a geologic environment (e.g., with surface equipment, etc.), a power supply 205, the ESP 210, a controller 230, a motor controller 250 and a VSD unit 270. The power supply 205 may receive power from a power grid, an onsite generator (e.g., natural gas driven turbine), or other source. The power supply 205 may supply a voltage, for example, of about 4.16 kV.

As shown, the well 203 includes a wellhead that can include a choke (e.g., a choke valve). For example, the well 203 can include a choke valve to control various operations such as to reduce pressure of a fluid from high pressure in a closed wellbore to atmospheric pressure. Adjustable choke valves can include valves constructed to resist wear due to high-velocity, solids-laden fluid flowing by restricting or sealing elements. A wellhead may include one or more sensors such as a temperature sensor, a pressure sensor, a solids sensor, etc.

As to the ESP 210, it is shown as including cables 211 (e.g., or a cable), a pump 212, gas handling features 213, a pump intake 214, a motor 215, one or more sensors 216 (e.g., temperature, pressure, strain, current leakage, vibration, etc.) and optionally a protector 217.

As an example, an ESP may include a REDA™ HOTLINE™ high-temperature ESP motor. Such a motor may be suitable for implementation in a thermal recovery heavy oil production system, such as, for example, SAGD system or other steam-flooding system.

As an example, an ESP motor can include a three-phase squirrel cage with two-pole induction. As an example, an ESP motor may include steel stator laminations that can help focus magnetic forces on rotors, for example, to help reduce energy loss. As an example, stator windings can include copper and insulation.

In the example of FIG. 2, the well 203 may include one or more well sensors 220, for example, such as the commercially available OPTICLINE™ sensors or WELLWATCHER BRITEBLUE™ sensors marketed by Schlumberger Limited (Houston, Tex.). Such sensors are fiber-optic based and can provide for real time sensing of temperature, for example, in SAGD or other operations. As shown in the example of FIG. 1, a well can include a relatively horizontal portion. Such a portion may collect heated heavy oil responsive to steam injection. Measurements of temperature along the length of the well can provide for feedback, for example, to understand conditions downhole of an ESP. Well sensors may extend thousands of feet into a well (e.g., 4,000 feet or more) and beyond a position of an ESP.

In the example of FIG. 2, the controller 230 can include one or more interfaces, for example, for receipt, transmission or receipt and transmission of information with the motor controller 250, a VSD unit 270, the power supply 205 (e.g., a gas fueled turbine generator, a power company, etc.), the network 201, equipment in the well 203, equipment in another well, etc.

As shown in FIG. 2, the controller 230 may include or provide access to one or more modules or frameworks. Further, the controller 230 may include features of an ESP motor controller and optionally supplant the ESP motor controller 250. For example, the controller 230 may include the UNICONN™ motor controller 282 marketed by Schlumberger Limited (Houston, Tex.). In the example of FIG. 2, the controller 230 may access one or more of the PIPESIM™ framework 284, the ECLIPSE™ framework 286 marketed by Schlumberger Limited (Houston, Tex.) and the PETREL™ framework 288 marketed by Schlumberger Limited (Houston, Tex.) (e.g., and optionally the OCEAN™ framework marketed by Schlumberger Limited (Houston, Tex.)).

In the example of FIG. 2, the motor controller 250 may be a commercially available motor controller such as the UNICONN™ motor controller. The UNICONN™ motor controller can connect to a SCADA system, the ESPWATCHER™ surveillance system, etc. The UNICONN™ motor controller can perform some control and data acquisition tasks for ESPs, surface pumps or other monitored wells. The UNICONN™ motor controller can interface with the PHOENIX™ monitoring system, for example, to access pressure, temperature and vibration data and various protection parameters as well as to provide direct current power to downhole sensors (e.g., sensors of a gauge, etc.).

The PHOENIX™ monitoring system includes a "gauge", which can be available in various configurations. As an example, a configuration of the gauge may provide for measurement of intake pressure and temperature, motor oil or motor winding temperature, vibration, and current leakage. As another example, a configuration of the gauge can provide for measurement of pump discharge pressure, which can be used in evaluating pump performance.

The PHOENIX™ monitoring system includes high-temperature microelectronics and digital telemetry circuitry that can communicates with surface equipment through an ESP motor cable. The electrical system of the PHOENIX™ monitoring system has a tolerance for high phase imbalance and a capacity to handle voltage spikes.

As an example, a controller can be operatively coupled to the PHOENIX™ monitoring system, for example, to provide remote access and control. Data can be integrated with a real-time surveillance service that may provide for robust surveillance of monitored parameters (e.g., via satellite and/or other network technologies). The PHOENIX™ monitoring system is SCADA ready and has a MODBUS protocol terminal with RS232 and RS485 ports for data output.

As to some examples of gauge parameters, consider Table 1 below.

TABLE 1

Some examples of gauge parameters for sensors.

| Measurement | Range | Accuracy | Resolution | Drift | Rate |
|---|---|---|---|---|---|
| P Intake | 0-40 MPa | +/− 34 | 0.7 | 34/year | 4 s |
| P Discharge | 0-40 MPa | +/− 34 | 0.7 | 34/year | 4 s |
| T Intake | 0-150 C | 1.3% FS | 0.1 | NA | 4 s/8 s |
| T Winding/Oil | 0-409 C | 1% FS | 0.1 | NA | 36 s |
| Vibration | 0-30 G | 3.3% FS | 0.1 | NA | Variable |
| Current Leak | 0-25 mA | 0.2% FS | 0.001 | NA | Variable |

As to dimensions of a gauge, consider a gauge that is approximately 60 centimeters in length and approximately 11 cm in diameter. Such a gauge may be rated to withstand pressures of approximately 45 MPa and survive for 24 hours at a temperature of approximately 175 degrees C. A surface choke unit may provide for reading sensed information from a three-phase ESP power cable.

The UNICONN™ motor controller can interface with fixed speed drive (FSD) controllers or a VSD unit, for example, such as the VSD unit 270. For FSD controllers, the UNICONN™ motor controller can monitor ESP system three-phase currents, three-phase surface voltage, supply voltage and frequency, ESP spinning frequency and leg ground, power factor and motor load.

For VSD units, the UNICONN™ motor controller can monitor VSD output current, ESP running current, VSD output voltage, supply voltage, VSD input and VSD output power, VSD output frequency, drive loading, motor load, three-phase ESP running current, three-phase VSD input or output voltage, ESP spinning frequency, and leg-ground.

In the example of FIG. 2, the ESP motor controller 250 includes various modules to handle, for example, backspin of an ESP, sanding of an ESP, flux of an ESP and gas lock of an ESP. The motor controller 250 may include any of a variety of features, additionally, alternatively, etc.

In the example of FIG. 2, the VSD unit 270 may be a low voltage drive (LVD) unit, a medium voltage drive (MVD) unit or other type of unit (e.g., a high voltage drive, which may provide a voltage in excess of about 4.16 kV). As an example, the VSD unit 270 may receive power with a voltage of about 4.16 kV and control a motor as a load with a voltage from about 0 V to about 4.16 kV. The VSD unit 270 may include commercially available control circuitry such as the SPEEDSTAR™ MVD control circuitry marketed by Schlumberger Limited (Houston, Tex.).

Figure 3:
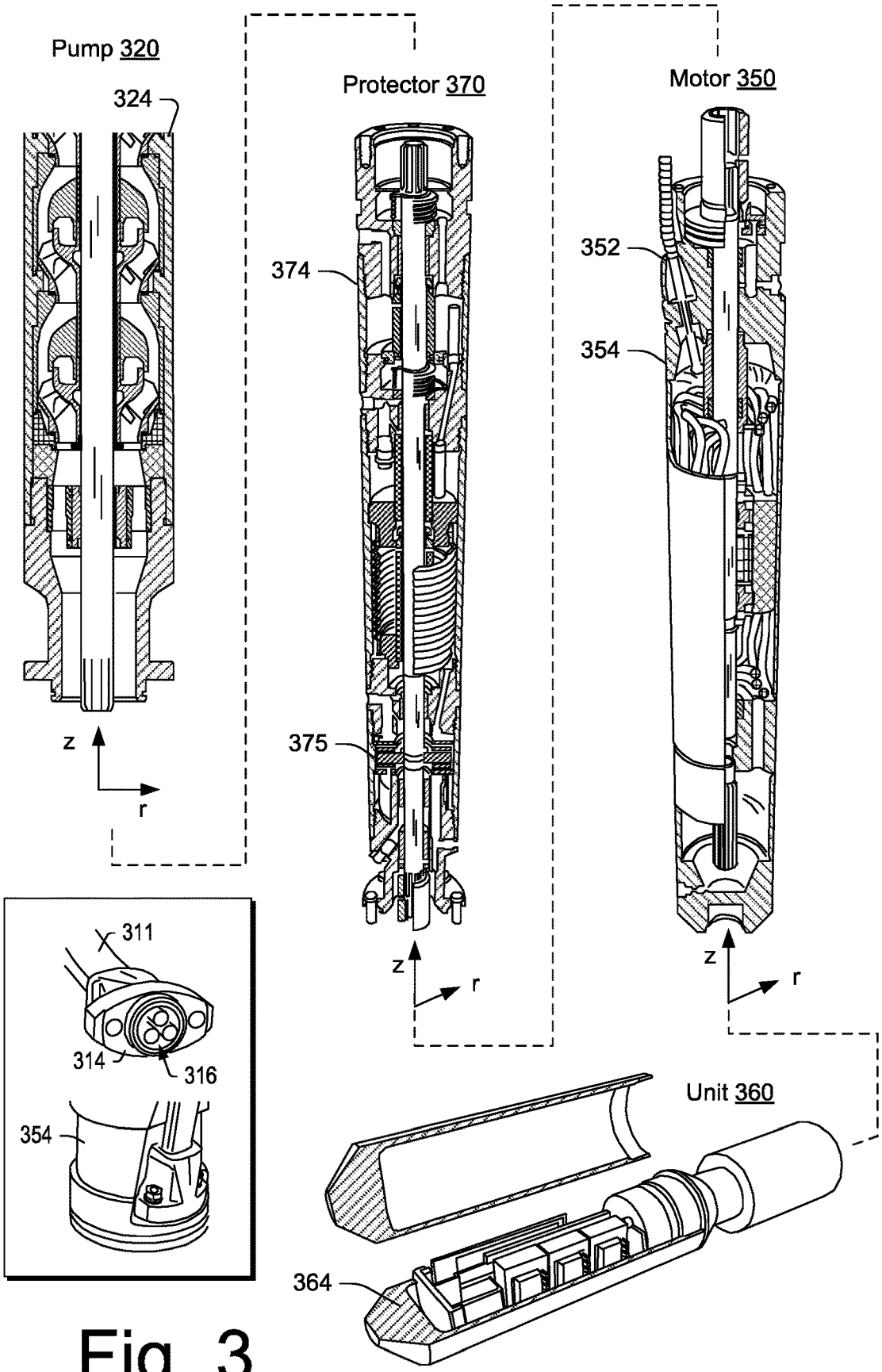
FIG. 3 illustrates examples of equipment.

FIG. 3 shows cut-away views of examples of equipment such as, for example, a portion of a pump 320, a protector 370, a motor 350 of an ESP and a sensor unit 360 (e.g., a gauge). The pump 320, the protector 370, the motor 350 and the sensor unit 360 are shown with respect to cylindrical coordinate systems (e.g., r, z, Θ). Various features of equipment may be described, defined, etc. with respect to a cylindrical coordinate system. As an example, a lower end of the pump 320 may be coupled to an upper end of the protector 370, a lower end of the protector 370 may be coupled to an upper end of the motor 350 and a lower end of the motor 350 may be coupled to an upper end of the sensor unit 360 (e.g., via a bridge or other suitable coupling).

As shown in FIG. 3, the pump 320 can include a housing 324, the motor 350 can include a housing 354, the sensor unit 360 can include a housing 364 and the protector 370 can include a housing 374 where such housings may define interior spaces for equipment. As an example, a housing may have a maximum diameter of up to about 30 cm and a shaft may have a minimum diameter of about 2 cm. As an example, a sensor can include a sensor aperture that is disposed within an interior space of a housing where, for example, an aperture may be in a range of about 1 mm to about 20 mm. In some examples, the size of an aperture may be taken into account, particularly with respect to the size of a shaft (e.g., diameter or circumference of a shaft). As an example, given dynamics that may be experienced during operation of equipment (e.g., a pump, a motor, a protector, etc.), error compensation may be performed that accounts for curvature of a shaft or, for example, curvature of a rotating component connected to the shaft.

As an example, an annular space can exist between a housing and a bore, which may be an open bore (e.g., earthen bore, cemented bore, etc.) or a completed bore (e.g., a cased bore). In such an example, where a sensor is disposed in an interior space of a housing, the sensor may not add to the overall transverse cross-sectional area of the housing. In such an example, risk of damage to a sensor may be reduced while tripping in, moving, tripping out, etc., equipment in a bore.

As an example, a protector can include a housing with an outer diameter up to about 30 cm. As an example, consider a REDA MAXIMUS™ protector (Schlumberger Limited, Houston, Tex.), which may be a series 387 with a 3.87 inch housing outer diameter (e.g., about 10 cm) or a series 562 with a 5.62 inch housing outer diameter (e.g., about 14 cm) or another series of protector. As an example, a REDA MAXIMUS™ series 540 protector can include a housing outer diameter of about 13 cm and a shaft diameter of about 3 cm and a REDA MAXI MUS™ series 400 protector can include a housing outer diameter of about 10 cm and a shaft diameter of about 2 cm. In such examples, a shaft to inner housing clearance may be an annulus with a radial dimension of about 5 cm and about 4 cm, respectively. Where a sensor and/or circuitry operatively coupled to a sensor are to be disposed in an interior space of a housing, space may be limited radially; noting that axial space can depend on one or more factors (e.g., components within a housing, etc.). For example, a protector can include one or more dielectric oil chambers and, for example, one or more bellows, bags, labyrinths, etc. In the example of FIG. 3, the protector 370 is shown as including a thrust bearing 375 (e.g., including a thrust runner, thrust pads, etc.).

As to a motor, consider, for example, a REDA MAXI MUS™ PRO MOTOR™ electric motor (Schlumberger Limited, Houston, Tex.), which may be a 387/456 series with a housing outer diameter of about 12 cm or a 540/562 series with a housing outer diameter of about 14 cm. As an example, consider a carbon steel housing, a high-nickel alloy housing, etc. As an example, consider an operating frequency of about 30 to about 90 Hz. As an example, consider a maximum windings operating temperature of about 200 degrees C. As an example, consider head and base radial bearings that are self-lubricating and polymer lined. As an example, consider a pot head that includes a cable connector for electrically connecting a power cable to a motor.

As shown in FIG. 3, a shaft segment of the pump 320 may be coupled via a connector to a shaft segment of the protector 370 and the shaft segment of the protector 370 may be coupled via a connector to a shaft segment of the motor 350. As an example, an ESP may be oriented in a desired direction, which may be vertical, horizontal or other angle (e.g., as may be defined with respect to gravity, etc.). Orientation of an ESP with respect to gravity may be considered as a factor, for example, to determine ESP features, operation, etc.

As shown in FIG. 3, the motor 350 is an electric motor that includes a cable connector 352, for example, to operatively couple the electric motor to a multiphase power cable, for example, optionally via one or more motor lead extensions. Power supplied to the motor 350 via the cable connector 352 may be further supplied to the sensor unit 360, for example, via a wye point of the motor 350 (e.g., a wye point of a multiphase motor).

As an example, a connector may include features to connect one or more transmission lines dedicated to a monitoring system. For example, the cable connector 352 may optionally include a socket, a pin, etc., that can couple to a transmission line dedicated to the sensor unit 360. As an example, the sensor unit 360 can include a connector that can connect the sensor unit 360 to a dedicated transmission line or lines, for example, directly and/or indirectly.

As an example, the motor 350 may include a transmission line jumper that extends from the cable connector 352 to a connector that can couple to the sensor unit 360. Such a transmission line jumper may be, for example, one or more conductors, twisted conductors, an optical fiber, optical fibers, a waveguide, waveguides, etc. As an example, the motor 350 may include a high-temperature optical material that can transmit information. In such an example, the optical material may couple to one or more optical transmission lines and/or to one or more electrical-to-optical and/or optical-to-electrical signal converters.

FIG. 3 shows an example of a cable 311 that includes a connector 314 and conductors 316, which may be utilized to deliver multiphase power to an electric motor and/or to communicate signals and/or to delivery DC power (e.g., to power circuitry operatively coupled to a wye point of an electric motor, one or more sensors, etc.). As an example, the cable connector 352 may be part of a pot head portion of a housing 354. As an example, the cable 311 may be flat or round. As an example, a system may utilized one or more motor lead extensions (MLEs) that connect to one or more cable connectors of an electric motor. As an example, the sensor unit 360 can include transmission circuitry that can transmit information via a wye point of the motor 350 and via the cable connection 352 to the cable 311 where such information may be received at a surface unit, etc. (e.g., consider a choke, etc. that can extract information from one or more multiphase power conductors, etc.).

Figure 4:
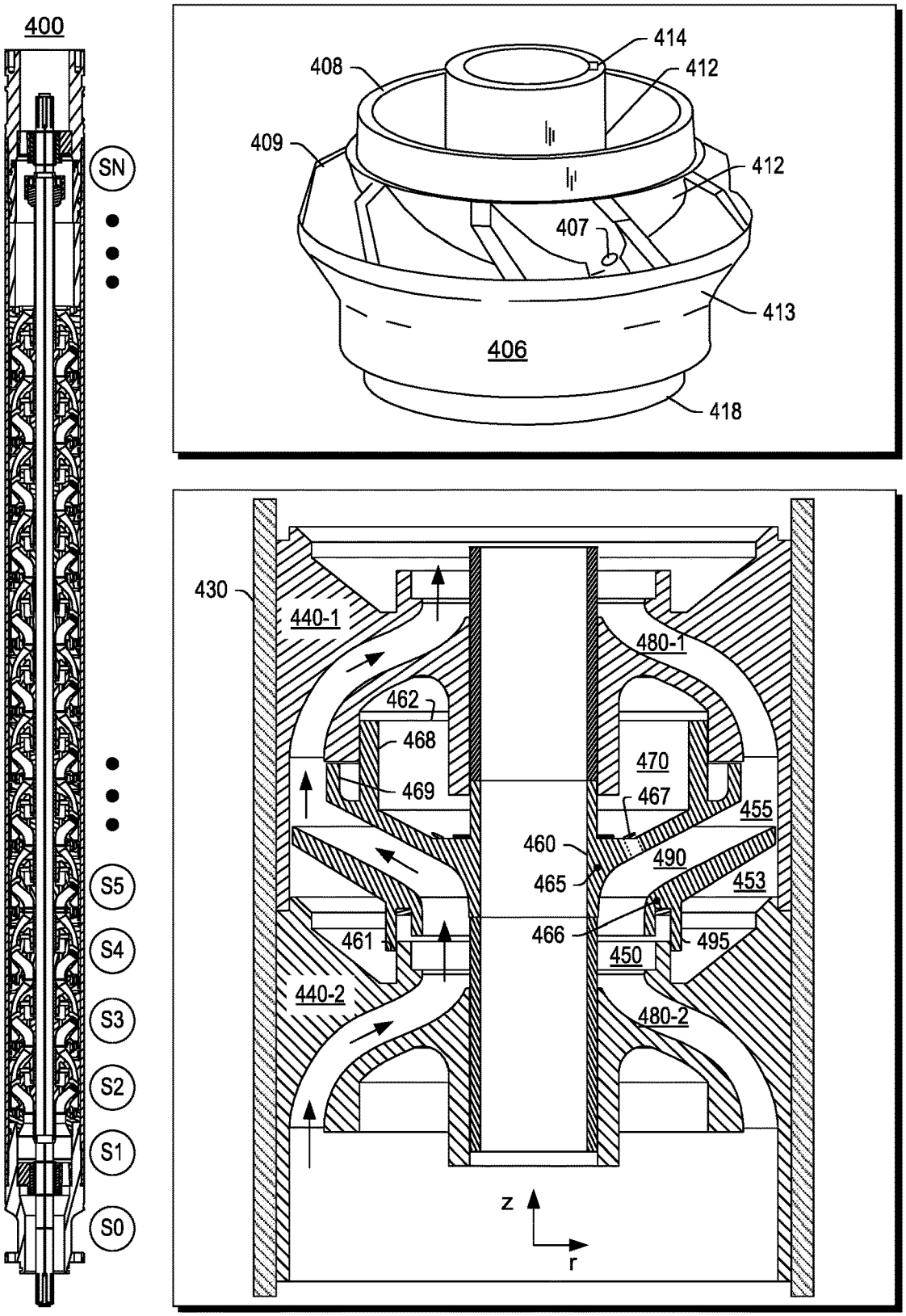
FIG. 4 illustrates an example of an assembled pump section with a plurality of stages.

FIG. 4 shows a cut-away view of a pump 400 that includes a stack of impeller and diffuser stages where the impellers are operatively coupled to a shaft that may be driven by an electric motor (see, e.g., the electric motor 350 of FIG. 3). In such a pump, various forces exist during operation as fluid is propelled from lower stages to upper stages of a stack. As an example, a pump may be oriented vertically, horizontally or at an angle between vertical and horizontal with respect to an environment. In such an example, vertical may be aligned substantially with gravity.

FIG. 4 also shows a perspective view of an example of an impeller 406 that includes balance holes 407, an upper balance ring 408, impeller blades 409, a hub portion 412 (e.g., a hub), a shroud portion 413 (e.g., a shroud), a keyway 414 and a front seal 418. As an example, a shaft may be inserted in a bore of the hub portion 412 where a key is disposed at least in part in a keyway of the shaft and at least in part in the keyway 414 of the hub portion 412 of the impeller 406. In such a manner, rotation of the shaft can cause rotation of the impeller 406 and, for example, the impeller 406 may move axially to some extent with respect to the shaft.

During operation, a shaft can rotatably drive the impeller 406 such that fluid may flow both axially and radially, which may be referred to as "mixed" flow. For example, fluid can enter the impeller 406 via throats at a lower end interior to the front seal 418 and be driven by the rotating impeller 406 axially upwardly and radially outwardly to exit via throats proximate to the upper balance ring 408. In such an example, individual throats may be defined at least in part by adjacent impeller blades 409.

As an example, the balance holes 407 can provide for fluid communication between a throat space (e.g., space between adjacent vanes 409, a hub surface of the hub portion 412 and a shroud surface of the shroud portion 413) and an upper chamber that is at least in part radially interior to the upper balance ring 408. Such fluid communication can provide for balancing of pressure forces.

During operation, where a fluid may include particles, a portion of the particles may migrate radially exterior to the front seal 418 and a portion of the particles may migrate radially interior to the upper balance ring 408. Such particles may act as abrasive material that is moved by a rotating impeller, for example, in clearances with respect to one or more neighboring diffusers. Depending on characteristics of operation, position with respect to gravity, flow, fluid properties, particle properties, etc., particles may collect and build-up in one or more regions, which may detrimentally impact operation, performance, longevity, etc.

As to abrasive action, a balance ring of an impeller may wear as particles enter a clearance defined by a surface of the balance ring and, for example, a surface of a diffuser. Where such wear increases the clearance, pressure balancing of the impeller with respect to one or more neighboring diffusers may be effected. For example, a stage may experience an increase in down thrust forces because of higher back pressure on a hub side (e.g., in a chamber interior to an upper balance ring).

As an example, an upper portion of an impeller may be referred to as a fluid outlet side, a hub side, a trailing side, etc., and, as an example, a lower portion of an impeller may be referred to as a fluid inlet side, a shroud side, a leading side, etc. For example, an individual blade (e.g., or vane) of an impeller can include a leading edge and a trailing edge where fluid enters at the leading edge and exits at the trailing edge. As an example, two adjacent blades can form an inlet throat disposed between their respective leading edges and an outlet throat disposed between their respective trailing edges.

As an example, an impeller can include a primary balance ring that can act as a sand guard to expel sand particles that may be driven in a direction toward a balance chamber. In such an example, the primary balance ring or sand guard can be an extension portion, for example, from an impeller hub portion and tip. Where a sand guard is integral to an impeller, the sand guard rotates at the same rotational speed (e.g., rpm) as the impeller and thus can diffuse sand particles away from a balance ring area. Where one balance ring is disposed at a radius that is larger than another balance ring, the balance ring with the larger radius will move at a greater tangential speed (e.g., centimeters per second) than the balance ring with the smaller radius. As an example, tangential speed of a surface of a balance ring can be directly proportional to the radius of the surface of the balance ring.

Referring again to the pump 400 of FIG. 4, an enlarged cross-section view of a portion of the pump 400 is shown that includes a housing 430 (e.g., a cylindrical tube-shaped housing), a first diffuser 440-1, a second diffuser 440-2 and an impeller 460 disposed at least in part axially between the first diffuser 440-1 and the second diffuser 440-2. In the enlarged cross-sectional view, various features of the impeller 460 are shown, including a lower end 461, an upper end 462, a hub 465 (e.g., a hub portion of the impeller 460), a shroud 466 (e.g., a shroud portion of the impeller 460), a balance hole 467, an upper balance ring 468, an upper guard ring 469, and a lower balance ring 495. As shown in FIG. 4, the hub 465 includes a through bore that defines an axis (e.g., z-axis). Various features of the diffusers 440-1 and 440-2 are also shown in FIG. 4, including diffuser vanes 480-1 and 480-2. As an example, various features of an impeller, a diffuser, an assembly, etc., may be described with respect to a cylindrical coordinate system (e.g., r, z and Θ).

In the enlarged cross-sectional view, arrows are shown that approximately represent a general direction of fluid flow through the diffuser 440-2, the impeller 460 and the diffuser 440-1. For example, fluid can enter via leading edges of the vanes 480-2 of the diffuser 440-2 and reach a chamber 450 at the trailing edges of the vanes 480-2. As shown, the chamber 450 provides for flow of fluid to the leading edges of the blades 490 of the impeller 460, which, during rotation, can drive the fluid to a chamber 455 at the trailing edges of the blades 490 of the impeller 460. As shown, the chamber 455 provides for flow of fluid to the leading edges of the vanes 480-1 of the diffuser 440-1. The arrows indicate that flow can be both axial and radial as it progresses through the pump 400.

The enlarged cross-sectional view also shows chambers 453 and 470, which may be amenable to particle collection (e.g., sand build-up, etc.). For example, particles may move radially inward from the chamber 453 to the chamber 450. In such an example, particles may migrate into and through a clearance between a surface of the lower balance ring 495 and a surface of the diffuser 440-2. As to the chamber 470, particles may move radially inwardly from the chamber 455 to the chamber 470. In such an example, particles may migrate into and through a clearance between a surface of the upper guard ring 469 and a surface of the diffuser 440-1 and may migrate further into and through a clearance between a surface of the upper balance ring 468 and a surface of the diffuser 440-1.

As shown in the enlarged cross-sectional view of FIG. 4, the clearance formed by the upper guard ring 469 and the diffuser 440-1 may act to diminish migration of particles to the chamber 470. For example, without the upper guard ring 469, particles that reach the chamber 470 would have migrated via a single clearance from the chamber 455 to the chamber 470; whereas, with the upper guard ring 469, particles that reach the chamber 470 would have migrate via two clearances from the chamber 455 to the chamber 470.

Figure 5:
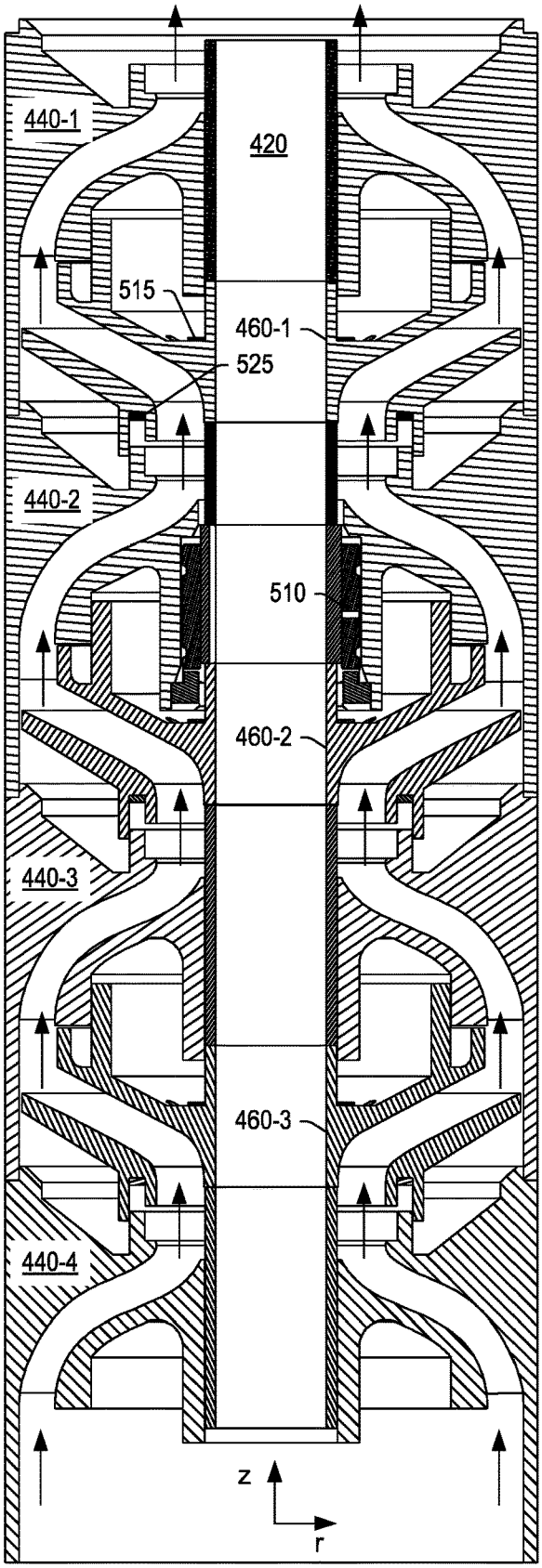
FIG. 5 illustrates an example of a portion of a pump section.

FIG. 5 shows an example of a portion of the pump 400 as including diffusers 440-1, 440-2, 440-3 and 440-4 and as including impellers 460-1, 460-2 and 460-3. As shown in FIG. 5, the pump 400 can include one or more bearing assemblies 510, one or more thrust washers 515 and one or more thrust washers 525. As to the diffuser 440-2, it is shown as including features to accommodate the bearing assembly 510. For example, the bearing assembly 510 may be accommodated (e.g., located, etc.) as least in part via a portion of the diffuser 440-2. In such an example, the bearing assembly 510 can rotatably support a shaft, which may be a multi-piece, stacked shaft that may include segments 420 stacked with respect to hub portions of impellers. As an example, a key or keys may optionally be utilized, for example, in conjunction with a keyway or keyways to couple rotating components of a pump.

Figure 6:
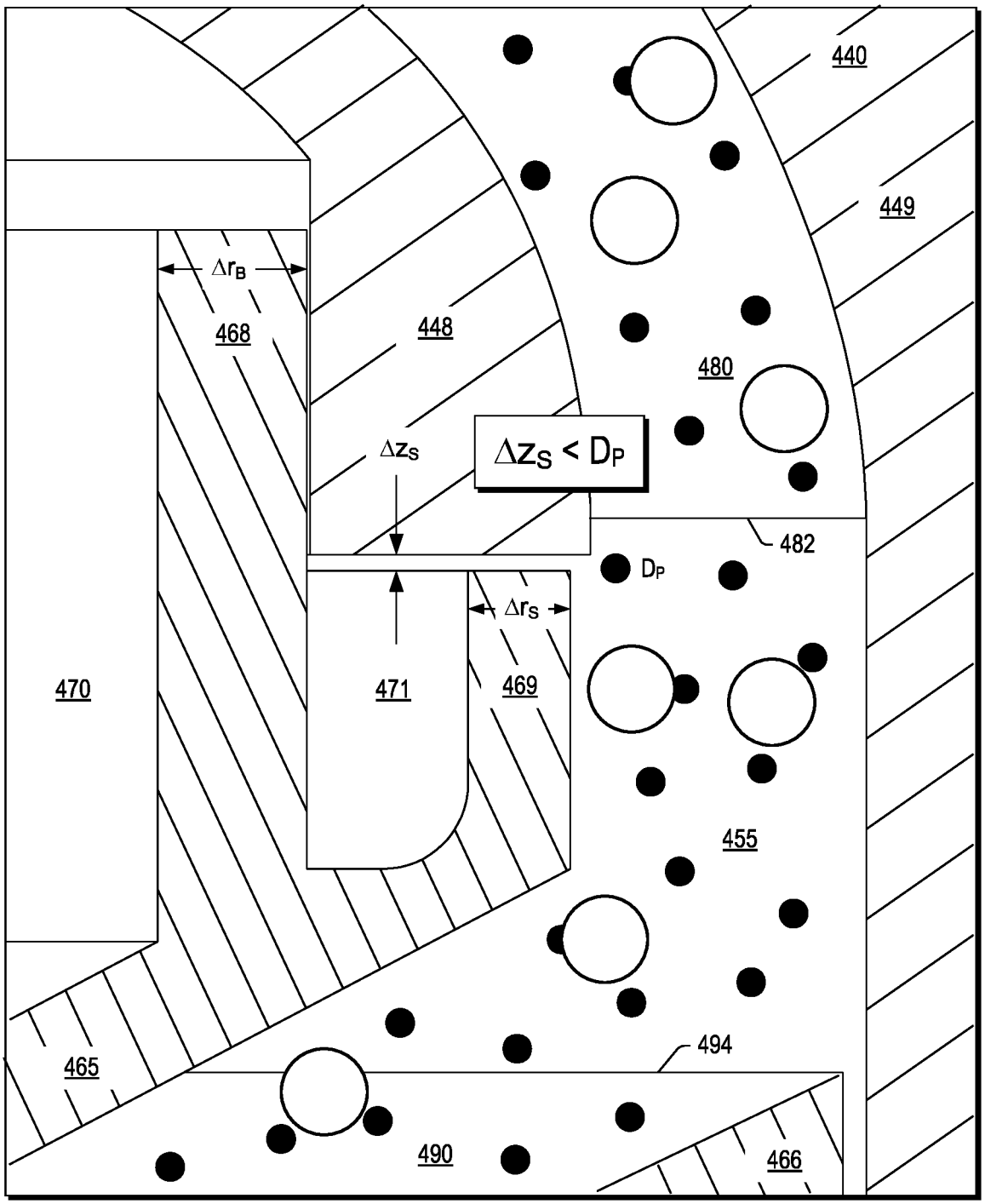
FIG. 6 illustrates an example of flow in a pump where fluid includes particles.

FIG. 6 shows an enlarged cross-sectional view of a portion of the pump 400 as including a diffuser 440 and an impeller 460, which define chambers 455, 470 and 471. In the example of FIG. 6, the chambers 455, 470 and 471 span a common axial distance. For example, a line may be drawn radially across that intersects the chambers 455, 470 and 471. However, in the example of FIG. 6, flow of fluid (e.g., and particles) is prohibited in such a direct radial manner.

In the example of FIG. 6, a clearance may be defined as Azs, which is between a surface of a portion 448 of the diffuser 440 and a surface of the upper guard ring 469. Such surfaces may be, for example, substantially annular, axially facing surfaces. As an example, at least a portion of particles in the chamber 455 may be of a particle size DP that exceeds the size of the clearance Azs. In such an example, such particles may be prohibited from entering the clearance formed in part by the upper guard ring 469 (e.g., a sand guard ring).

FIG. 6 also shows examples of gas bubbles flowing in the pump, noting that gas may be present at a larger volume. Gas and/or particles can affect operation of a pump. For example, as mentioned, particles may cause wear and may build up, both of which can decrease pump efficiency. Gas may cause a condition known as gas lock. Gas lock can occur in pumping equipment and/or processing equipment (e.g., as may be part of an artificial lift system). Gas lock can occur via the induction of free gas where such gas, being compressible, can interfere with proper operation of valves and/or pump components, for example, reducing intake of fluid.

In the example of FIG. 6, particles and/or gas may affect properties such as viscosity, heat capacity, density, etc., which may have an effect on efficiency. Where artificial lift aims to increase fluid flow, particles and/or gas (e.g., undesirable gas) may reduce efficiency. For example, energy may be wasted moving particles, compressing gas, etc.

As an example, during operation, the axial position of the impeller 460 may shift with respect to the axial position of the diffuser 440. In such an example, the clearance Azs may also change. As the size of the clearance changes, a greater or a lesser risk may exist for particles to enter the chamber 471. Depending on pressures and other forces, as well as characteristics of particles, particles may move radially inwardly or radially outwardly. For example, consider an operational mode that may reverse direction of rotation of a motor that drives a shaft to which impellers are operatively coupled. In such an example, where a clearance increases, forces may exist during "reverse" operation that cause particles to move radially outwardly, for example, to exit the chamber 471 via a clearance. As an example, a controller (e.g., a surface controller) may include an anti-sanding mode of operation that may utilize features of an impeller such as the impeller 460 of FIG. 6.

As an example, a drive may slow down rotational speed of a motor and then reverse the rotational direction of the motor and increase the rotational speed to a target speed, which may be, for example, an anti-sanding (e.g., de-sanding) speed. Such a speed may be based at least in part on sand conditions, indicated power losses (e.g., due to sanding), etc. After a period of time in reverse, the drive may ramp down the reverse rotation and re-commence operation in a rotational direction that causes fluid to be propelled in an intended direction (e.g., uphole, etc.). As an example, an anti-sanding operation may be a transient type of operation that aims to improve ESP operation (e.g., help to restore via clearing sand, etc.). In such an example, sand may accumulate over time and anti-sanding may aim to reduce the effect of sand accumulation over a shorter period of time. Such operational processes can be of different time scales and exhibit different types of transient behaviors. As an example, one or more sensors may sense data that captures such transient behavior(s).

As to the upper balance ring 468, it is illustrated in the example of FIG. 6 as including a radial thickness ArB and as having an axial dimension that is greater than that of the upper guard ring 469 such that a clearance is formed between a radially, outwardly facing surface of the upper balance ring 468 and a radially, inwardly facing surface of the portion 448 of the diffuser 440. Such a clearance may be sized to allow for axial movement of the impeller 460 with respect to the diffuser 440 while retaining a pressure balancing function of the chamber 470. As mentioned, where the radially, outwardly facing surface of the upper balance ring 468 and/or the radially, inwardly facing surface of the portion 448 of the diffuser 480 wear (e.g., due to sand abrasion), fluid may flow more readily within the enlarged clearance, which, in turn, may diminish the pressure balancing function of the chamber 470. Again, a sand guard (e.g., an upper guard ring) may help to preserve such pressure balancing function where fluid includes particles (e.g., sand particles, etc.).

As to gas lift equipment, as mentioned, gas may be injected from an annulus into tubing. An annulus, as applied to an oil well or other well for recovering a subsurface resource may refer to a space, lumen, or void between piping, tubing or casing and the piping, tubing, or casing immediately surrounding it, for example, at a greater radius.

As an example, injected gas may aerate well fluid in production tubing in a manner that "lightens" the well fluid such that the fluid can flow more readily to a surface location. As an example, one or more gas lift valves may be configured to control flow of gas during an intermittent flow or a continuous flow gas lift operation. As an example, a gas lift valve may operate based at least in part on a differential pressure control that can actuate a valve mechanism of the gas lift valve.

As gas lift valve may include a so-called hydrostatic pressure chamber that, for example, may be charged with a desired pressure of gas (e.g., nitrogen, etc.). As an example, an injection-pressure-operated (IPO) gas lift valve or an unloading valve can be configured so that an upper valve in a production string opens before a lower valve in the production string opens.

As an example, a gas lift valve may be configured, for example, in conjunction with a mandrel, for placement and/or retrieval of the gas lift valve using a tool. For example, consider a side pocket mandrel that is shaped to allow for installation of one or more components at least partially in a side pocket or side pockets where a production flow path through the side pocket mandrel may provide for access to a wellbore and completion components located below the side pocket mandrel. As an example, a side pocket mandrel can include a main axis and a pocket axis where the pocket axis is offset a radial distance from the main axis. In such an example, the main axis may be aligned with production tubing, for example, above and/or below the side pocket mandrel.

As an example, a tool may include an axial length from which a portion of the tool may be kicked-over (e.g., to a kicked-over position). In such an example, the tool may include a region that can carry a component such as a gas lift valve. An installation process may include inserting a length of the kickover tool into a side pocket mandrel (e.g., along a main axis) and kicking over a portion of the tool that carries a component toward the side pocket of the mandrel to thereby facilitate installation of the component in the side pocket. A removal process may operate in a similar manner, however, where the portion of the tool is kicked-over to facilitate latching to a component in a side pocket of a side pocket mandrel.

In operation, injection gas may be provided to a well via a compressor and a regulator. The lifted fluid, including injected gas, may flow to a manifold, for example, where fluid from a number of wells may be combined. As an example, a manifold may be operatively coupled to a separator, which may separate components of the fluid. For example, the separator may separate oil, water and gas components as substantially separate phases of a multiphase fluid. In such an example, oil may be directed to an oil storage facility while gas may be directed to the compressor, for example, for re-injection, storage and/or transport to another location. As an example, water may be directed to a water discharge, a water storage facility, etc.

As an example, well equipment can include a well-head (e.g., a Christmas tree, etc.), an inlet conduit for flow of compressed gas, an outlet conduit for flow of produced fluid, a casing, a production conduit, and a packer that forms a seal between the casing and the production conduit. Fluid may enter the casing (e.g., via perforations) and then enter a lumen of the production conduit, for example, due to a pressure differential between the fluid in the subterranean geologic environment and the lumen of the production conduit at an opening of the production conduit. Where the inlet conduit for flow of compressed gas is used to flow gas to the annular space between the casing and the production conduit, a mandrel operatively coupled to the production conduit that includes a pocket that seats a gas lift valve that may regulate the introduction of the compressed gas into the lumen of the production conduit. In such an example, the compressed gas introduced may facilitate flow of fluid upwardly to the well-head (e.g., opposite a direction of gravity) where the fluid may be directed away from the well-head via the outlet conduit.

As an example, where a gas lift valve includes one or more actuators, such actuators may optionally be utilized to control, at least in part, operation of a gas lift valve (e.g., one or more valve members of a gas lift valve). As an example, surface equipment can include one or more control lines that may be operatively coupled to a gas lift valve or gas lift valves, for example, where a gas lift valve may respond to a control signal or signals via the one or more control lines. As an example, surface equipment can include one or more power lines that may be operatively coupled to a gas lift valve or gas lift valves, for example, where a gas lift valve may respond to power delivered via the one or more power lines. As an example, a system can include one or more control lines and one or more power lines where, for example, a line may be a control line, a power line or a control and power line.

As to a rod pumping (RP) assembly, it may be driven by a pump drive system that is operatively coupled to a controller. A pump assembly and a drive system can be arranged as a beam pump. For example, a walking beam may reciprocate a rod string that includes a polished rod portion that can move in a bore of a stuffing box of a well head assembly that includes a discharge port. The rod string can be suspended from the walking beam via a horse head for actuating a downhole pump of the pump assembly where the downhole pump is positioned in a well, for example, near a bottom of the well.

A well in a subterranean environment may be a cased well or an open well or, for example, a partially cased well that can include an open well portion or portions. A well can includes casing that defines a cased bore where tubing is disposed in the cased bore. An annular space can exist between an outer surface of the tubing and an inner surface of the casing.

In a rod pumping system, a walking beam can be actuated by a pitman arm (or pitman arms), which is reciprocated by a crank arm (or crank arms) driven by an electric motor. Such an electric motor can be coupled to the crank arm through a gear reduction mechanism, such as gears of a gearbox. As an example, the electric motor can be a three-phase AC induction motor that can be controlled via circuitry of the controller, which may be connected to a power supply. The gearbox of the pump drive system can convert electric motor torque to a low speed, high torque output for driving the crank arm. The crank arm can be operatively coupled to a counterweight that serves to balance the rod string as suspended from the horse head of the walking beam. A counterbalance may be provided by an air cylinder such as those found on air-balanced units.

A downhole pump can be a reciprocating type pump that includes a plunger attached to an end of a rod string and a pump barrel, which may be attached to an end of tubing in a well. A plunger can include a traveling valve and a standing valve positioned at or near a bottom of a pump barrel. During operation, for an up stroke where the rod string translates upwardly, the traveling valve can close and lift fluid (e.g., oil, water, etc.) above the plunger to a top of the well and the standing valve can open to allow additional fluid from a reservoir to flow into the pump barrel. As to a down stroke where the rod string translates downwardly, the traveling valve can open and the standing valve can close to prepare for a subsequent cycle. Operation of the downhole pump may be controlled such that a fluid level is maintained in the pump barrel where the fluid level can be sufficient to maintain the lower end of the rod string in the fluid over its entire stroke.

As an example, a well can include a choke, which may be an adjustable chock, optionally controllable by a surface controller (e.g., computer, controller, actuator, etc.) that includes circuitry to transmit control information (e.g., commands, signals, etc.) to the choke (e.g., to adjust flow rate, etc.). As an example, an adjustable choke can be a valve, located on or near a Christmas tree that is used to control production of fluid from a well. In such an example, opening or closing the variable valve can influence the rate and pressure at which production fluids progress through the pipeline or process facilities. As mentioned, an adjustable choke may be linked to an automated control system to enable production parameters of individual wells to be regulated (e.g., controlled, etc.).

As an example, a production process may optionally utilize one or more fluid pumps such as, for example, an electric submersible pump (e.g., consider a centrifugal pump, a rod pump, etc.). As an example, a production process may implement one or more so-called "artificial lift" technologies. An artificial lift technology may operate by adding energy to fluid, for example, to initiate, enhance, etc. production of fluid.

As explained above, an artificial lift system, as deployed, interacts with its environment. Such an environment may be dynamic in that it changes with respect to time during operation of an artificial lift system. As an example, an artificial lift system may change over time during operation. For example, a gas lift valve may experience wear, a rod pump may experience wear and an ESP may experience wear. Wear may be associated with a lifetime such as a remaining useful lifetime (RUL) of an artificial lift system.

As operational behaviors can be dynamic and complex for artificial lift systems, characterizing behavior directly based on data from a sensor may be informative though inadequate for one or more reasons. To more fully characterize behavior of an artificial lift system, a computational system can provide multiple components as tools that provide different routes to characterize behavior. For example, consider a computation system that generates a digital twin of at least a portion of an artificial lift system via one or more of learning and physical model-based inversion.

As an example, consider a sensor that output data as time series data. In an ESP, such a sensor may be an intake pressure sensor of a gauge while in a rod pump, such a sensor may be a load cell. As to a gas lift system, consider a valve vibration sensor. In such examples, the time series data may include variations of a certain time scale that is not adequately modeled via one or more physical models, particularly in a short period of time (e.g., real-time analysis, etc.). Such time series data may be processed via a learning process such as, for example, an artificial neural network (ANN) that can train an ANN for use in processing data to provide output (e.g., values for one or more state variables). As to some examples of data sampling rates of various sensors, see Table 1.

As an example, an analysis engine that can perform learning may operate as a machine learning (ML) engine. As an example, an analysis engine may operate with respect to an ANN or other type of network. Various neural network learning algorithms (e.g., back propagation, etc.) can implement one or more gradient descent algorithms. As to Bayes net learning in comparison to neural net learning, in Bayes net learning there tend to be fewer hidden nodes where learned relationships between the nodes may be more complex, for example, as a result of the learning having a direct physical interpretation (e.g., via probability theory) rather than being black-box type weights, and the result of the learning can be more modular (e.g., portions separated off and combined with other learned structures). As an example, a Bayes approach may be utilized for inversion. As an example, a learning process may or may not have intrinsic meaning. For example, consider concepts of a white box approach and a black box approach where the white box may have some amount of intrinsic meaning whereas a black box can operate without such intrinsic meaning. As an example, a Bayesian network can operate with intrinsic meaning behind its structure; whereas, for example, an artificial neural network can operate without such intrinsic meaning.

An inversion process may be implemented via an analysis engine where the inversion process addresses one or more inverse problems, which involve calculating, from observations, causal factors that produced the observations: for example, consider calculating an image in X-ray computed tomography from X-ray attenuation data (e.g., utilizing an inverse transform), source reconstruction in acoustics, or calculating the density of the Earth from measurements of its gravity field. An inverse problem can starts with results and then calculate causes, which is opposite of a forward problem that starts with causes and then calculates results (e.g., consider a forward simulation in time, etc.).

As an example, an analysis engine can include one or more features of the APACHE STORM engine (Apache Software Foundation, Forest Hill, Md.). As an example, a method can include implementing a topology that includes a directed acyclic graph. For example, the APACHE STORM application can include utilization of a topology that includes a directed acyclic graph (DAG). A DAG can be a finite directed graph with no directed cycles that includes many vertices and edges, with each edge directed from one vertex to another, such that there is no way to start at any vertex v and follow a consistently-directed sequence of edges that eventually loops back to v again. As an example, a DAG can be a directed graph that includes a topological ordering, a sequence of vertices such that individual edges are directed from earlier to later in the sequence. As an example, a DAG may be used to model different kinds of information. As another example, an analysis engine can include one or more features of the NETICA framework (Norsys Software Corp., Vancouver, Canada), which includes features that generate and use networks to perform various kinds of inference where, for example, given a scenario with limited knowledge, appropriate values or probabilities may be determined for unknown variables. As yet another example, an analysis engine can include one or more features of the TENSOR FLOW (Google, Mountain View, Calif.) framework, which includes a software library for dataflow programming that provides for symbolic mathematics, which may be utilized for machine learning applications such as artificial neural networks (ANNs), etc.

As an example, a digital twin of an artificial lift system can be a digital avatar that can be utilized to computationally run an artificial lift system in a computational environment. As an example, a digital twin of an artificial lift system can be utilized to output information to a surface controller or surface controllers that are operatively coupled to one or more artificial lift systems. As an example, a digital twin can include various features as developed via analysis of real data (e.g., observations, sensor data, etc.). As an example, a digital twin can provide for state variable identification. For example, consider an artificial lift system that may have approximately one hundred (e.g., or more) state variables but have a limited set of sensors that can directly measure a fraction of the state variables. In such an example, a black box machine learning engine may be implemented to identify state variables and values thereof from a black box perspective while a white box approach using an inversion engine may also be implemented to provide values of state variables via a plurality of physics-based models from an informed perspective (e.g., real-world physics underlying the physics-based models). Such a mixed or hybrid or grey box approach for handling state variables can be multi-perspective and provide system information in a manner that can account for a broad range of time scales. For example, a physics-based model may be viable within a limited range as to time scale while a black box approach (e.g., ANN, etc.) may be capable of outputting meaningful information on a time scale or scales that may be beyond the capabilities of a physics-based model.

As an example, a digital twin can be a multi-physics, multiscale, simulator of an artificial lift system that uses physical models, as-built manufacturing data, and time series sensor data from a corresponding installed system. Such an approach can account for fleet operations history, for example, to mirror operations and life of a physical twin. As an example, a system that can generate and utilize a digital twin may provide for cradle-to-grave or cradle-to-cradle workflows. For example, a digital twin can become enhanced beyond the features of its corresponding physical twin, which can inform a next generation of physical artificial lift system(s). As to cradle-to-cradle, such an approach may determine what components of an artificial lift system are amenable to reuse, optionally with conditioning, refurbishing, etc., and/or what components of an artificial lift system are amenable to material recycling (e.g., melting down, recasting, etc.). As an example, a cradle-to-X workflow may provide for design, installation, and operation of an artificial lift system (e.g., ESP, gas lift, rod pump, etc.).

A digital twin workflow can include a suite of simulation models which may be at various levels of scale and be sufficiently rich to describe a system-level response of an artificial lift system. Such models can be physical models (e.g., physics-based models), which may be referred to as "white box" as being based on equations of physics; whereas, data analytical models may include "black box" models that can be, for example, based on machine learning from time series sensor data, or combinations of both, (e.g., "grey box" models). As mentioned, machine learning may involve ANNs and/or Bayes networks, for example, to be along a spectrum from white box to black box.

As an example, a computational system can provide for system identification in the context of an artificial lift system. The term "system identification" originates with Zadeh (1956) as to a model estimation problem for dynamic systems in the realm of control. Two avenues for the development of the theory and methodology include the realization avenue, which starts from the theory how to realize linear state space models from impulse responses, leading to so-called subspace methods while the other avenue is the prediction-error approach, more in line with statistical time-series analysis.

As an example, white box models with known inputs and parameters may be utilized to model an artificial lift system such that hydraulic behavior, electrical behavior, reservoir behavior and the degrading health of artificial lift hardware may be accurately predicted. Models where system states can be predicted from a known set of inputs and parameters can be forward models. As mentioned, artificial lift systems can be quite complex such that various system inputs and parameters are unknown due to that system complexity along with impracticalities of installing various sensors in a downhole environment. As various state variables are not directly known via sensing (e.g., or forward modeling), determination of system information may be approached based on various system identification techniques. As mentioned, techniques can range from "off-white" where rich "white-box" physical models have unknown parameters to "black-box" where the model is built up from analytics of data signals (e.g., without basis in a physical model). Solution methods for this range of "off-white" to "black-box" models can include optimization, statistical or probabilistic, and machine learning.

A result of a system identification process can be a time evolving description of a system (e.g., via state variables, etc.), which may be via a generated digital twin that is based on measured responses and computed responses, as may be predicted from the system identification process.

Figure 7:
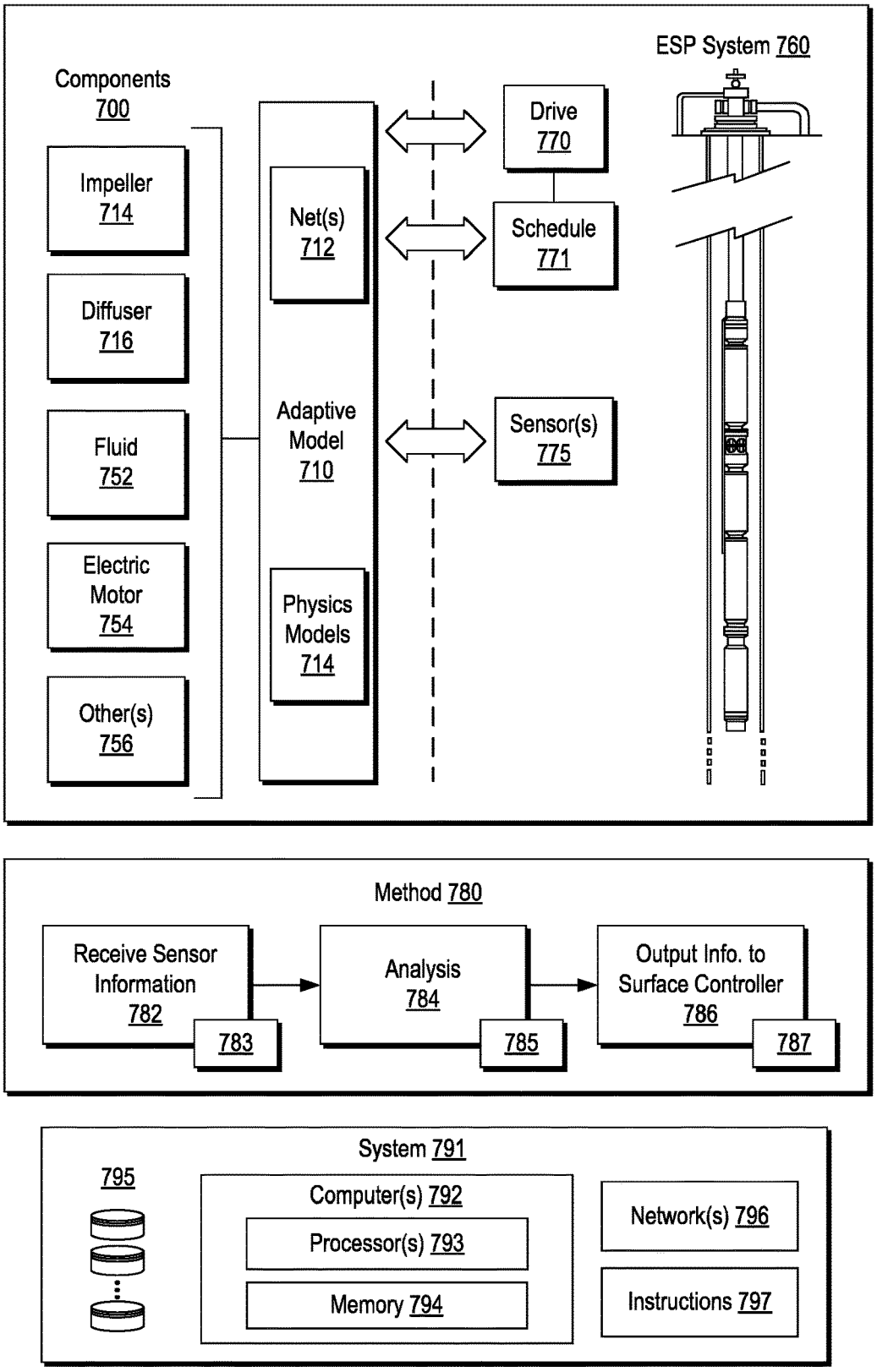
FIG. 7 illustrates examples of components of an adaptive model that can provide for control of an ESP system as well as an example of a method and an example of a computer system.

FIG. 7 shows examples of components 700 associated with an example of an adaptive model 710, an example of an ESP system 760, an example of a method 780, and an example of a computing system 791. While an ESP system is illustrated in FIG. 7, such an example may be applied to a gas lift system and/or a rod pumping system (see, e.g., FIG. 1).

As shown in FIG. 7, the adaptive model 710 includes a net(s) block 712 and a physics model block 714. In such an example, the net(s) block 712 represents one or more learning mechanisms that can operate on sensed data, optionally without underlying physics (e.g., a black box approach); whereas, the physics model block 714 represents a plurality of physics-based models that can provide for inversion and/or forward modeling.

As to the components 700, these can include an impeller component 714, a diffuser component 716, a fluid component 752, an electric motor component 754, and one or more other components 756. Such components may be part of the adaptive model 710, which may include, for example, an electrical model of components of an ESP system such as, for example, the ESP system 760.

As an example, a component can include information (e.g., specifications, settings, model(s), instructions, etc.) that can represent states of operation of equipment. For example, the impeller component 714 can include information as to one or more types of impellers, which can include information such as size, number of blades, angle(s) of blades, surface finish of blades, features of impeller, seal type(s), matching diffusers, material of manufacture, manufacture process, thermal properties, ratings for fluid, ratings for rotational speed, wear characteristics, wear limits, etc. In such an example, the impeller component 714 can provide for a state-based representation of various aspects of one or more impellers that are disposed in a pump section or pump sections of an electric submersible pump (ESP) (or ESPs). As the adaptive model 710 is adaptive, the impeller component 714 can be utilized in combination with sensor data to determine how the adaptive model 710 is to be adapted as to modeling of one or more impellers. For example, where the ESP system 760 is operated for a period of time to pump a type of fluid, the fluid may be characterized via the fluid component 752, the operation of the electric motor may be characterized via the electric motor component 754 and flow of the fluid may be characterized by a combination of the impeller component 714 and the diffuser component 716, which may be dynamic components in that their characterization depends on various factors to estimate condition of actual impellers and/or diffusers, which may be organized in a linear arrangement in stages where each stage includes an impeller and a diffuser.

Referring to FIG. 4, the pump 400 can include various sensors, illustrated as S0 to SN. As an example, such sensors can include temperature sensors. As an example, a temperature sensor can be positioned in a pump section with respect to a stage or adjacent stages to measure temperature at a position or positions. As an example, one or more thermodynamic models may account for movement of fluid, energy transferred to fluid, internal heating of fluid (e.g., viscous heating), heat transfer to and/or from fluid, heat transfer to one or more mechanical components, heat transfer to fluid exterior to a pump section, and heat transfer to tubing, casing, cement, rock, etc. As an example, temperature information sensed by one or more temperature sensors may inform a model or models and/or allow for analysis via one or more learning structures (e.g., ANNs, etc.). As mentioned, one or more types of input can be analyzed to determine one or more state variables (e.g., values for state variables) where sensor data may not provide for one or more of the one or more state variables directly. As mentioned, a combination of black box learning and model-based inversion may be utilized, for example, as implemented at least in part by one or more analysis engines (e.g., using local computational and/or data resources and/or remote computational and/or data resources, etc.).

As an example, a temperature sensor can be a thermocouple. A thermocouple is an electrical device that can include two dissimilar electrical conductors forming electrical junctions at differing temperatures. In such an example, the thermocouple can produce a temperature-dependent voltage as a result of the thermoelectric effect, and this voltage can be interpreted to measure temperature. As an example, a temperature sensor can be a thermistor, which is a type of resistor whose resistance is dependent on temperature. As an example, one or more temperature sensors can be included in a pump. In such an example, such sensors may be wired and/or wireless to transmit sensed information (e.g., time series data). As to wireless transmission, one or more antennas may be utilized to emit signals that can be received by another antenna. As an example, a unit such as the 360 of FIG. 3 may include one or more wired and/or wireless interfaces that can receive information from one or more sensors, which can be or include one or more temperature sensors. In such an example, sensed temperature information may be transmitted via a cable, for example, to a surface unit (e.g., a computing system, a controller, a drive, etc.). As an example, a pump section with a series of temperature sensors may output a temperature profile with respect to a longitudinal axis of the pump section, with respect to impellers, with respect to stages, etc. In such an example, fluid may be characterized at least in part on one or more temperature profiled. In such an example, a viscosity profile may be generated as an output by a digital twin where the viscosity profile may be based at least in part on one or more energy balances (e.g., energy models, energy equations, etc.) that relate viscosity and temperature (e.g., and/or one or more other variables such as power input, shaft rotational speed/impeller speed, pressure, etc.).

As an example, temperature information may be time series data amenable to analysis via the net(s) block 712 and amenable to analysis via the physics models block 714 (e.g., for inversion). As an example, outputs of the blocks 712 and 714 can differ. For example, the block 712 may output one state variable while the block 714 may output another state variable. In such an example, the same data may be processed via two different routes to output two different state variables (e.g., values for two different state variables). For example, one may output pressure while the other outputs rotational speed of a shaft that drives impellers. In such an example, one or more of pressure and/or rotational speed of the shaft may be available via one or more sensors or possibly unavailable where one or more corresponding sensors are not installed in a system and/or inoperable (e.g., due to failure, quality control, etc.).

In mechanics, position coordinates and velocities of mechanical parts may be state variables; knowing these, it may be possible to determine the future state of the objects in a system. In thermodynamics, a state variable may be a state function; examples include temperature, pressure, volume, internal energy, enthalpy, and entropy; whereas, heat and work may be process functions. In electronic circuits, voltages of nodes and currents through components in the circuit can be state variables. In control engineering, state variables can be used to represent the states of a system. The set of possible combinations of state variable values can be referred to as the state space of the system. Equations relating a current state of a system to its most recent input and past states can be referred to as state equations, and the equations expressing the values of the output variables in terms of the state variables and inputs can be referred to as output equations.

As an example, the adaptive model 710 can include one or more equations that can account for a relationship between energy, temperature and viscosity. For example, consider the law of conservation of energy as presented below for fluid in a tube with a tube wall:

$$\frac{d}{dt}\int_{\tau}\rho\left(U+\frac{V^2}{2}\right)d\tau=\int_{\tau}\rho F\ Vd\tau+\int_{s}p_n\ VdS+\int_{S}k\frac{\partial T}{\partial n}dS+\int_{\tau}\rho q d\tau$$

where ρ is the density, U is the internal energy, V is the flow velocity, F is the body force, $p_n$ is the surface force normal to surface, k is the thermal conductivity of the fluid, T is the temperature, q is the other heat flux, dτ and dS are the elements of volume and surface.

In the foregoing equation, the left side is the rate of change of energy, including internal energy U and kinetic energy $V^2/2$ while the terms on the right side are the work of body force, the work of surface force, the heat flux through a tube wall (e.g., including conduction and other heat flux such as, for example, radiation), respectively.

A control volume can be defines as a part within a tube wall and an entrance of a tube and an exit of a tube. With various assumptions, which may correspond to physical conditions that may be negligible contributions from one or more terms (e.g., one or more physical phenomena), the internal energy term may be represented as follows:

$$\int_s \rho U V_n ds=\rho C_P Q(T_{in}T_{out})=\rho C_P Q\ T$$

Further, kinetic energy, E, in a tube with a circular cross-sectional area may be represented as follows:

$$E \sim \frac{16\rho Q^3}{\pi^2 d^4}$$

Yet further, pressure (work of surface force) may be represented as follows:

$$\int_S p_n V_n dS = (P_{in} P_{out}) Q = PQ$$

In the foregoing equations, $C_P$ is the specific heat of the fluid, $V_n$ is the velocity normal to the surface and Q is the volume flow rate. In the tube equations, with a tube having a distance along an axis x, the viscosity can be given as a function of x, which, assuming that viscosity if a function of temperature, the apparent viscosity can be expressed as a function of pressure drop in the tube with an adiabatic boundary condition as follows:

$$\mu(x) = \mu_{in} e^{\frac{\beta}{T_{in}} T(x)} = \mu_{in} e^{\frac{\beta}{T_{in}} \frac{P(x)}{C_p \rho}}$$

where β is the property coefficient of the temperature-dependent viscosity.

As mentioned, factors such as solids in fluid, gas in fluid, etc., may alter fluid behavior, which may include alteration of viscosity in relationship to temperature, pressure and/or one or more other variables. As an example, where viscosity increases, entrained gas may face more resistance in rising while solids (e.g., particles) may face more resistance in settling. Where entrained gas and solids exist together in a volume of fluid, interactions may occur as entrained gas rises and solids settle. Such interactions may be complex where the volume of fluid is subject to an artificial lift technology (e.g., pumping, gas lift, etc.).

As shown by the foregoing example equations, an energy balance can provide various types of information where at least some information is known, which may, for example, be known through sensors, operational conditions, known behaviors, etc.

As an example, for an ESP with a pump section that includes multiple stages, energy input into the ESP via a cable to an electric motor that is operatively coupled to a shaft that rotates impellers of the stages, can result in a certain amount of viscous heating of fluid being pumped via rotation of the impellers (or at least a portion of the impellers). As such fluid is heated, its temperature can change and its viscosity may change where that viscosity is temperature dependent and/or where the fluid is multiphase and/or an emulsion, which may exhibit changes that can be a result of the fluid being worked on by impellers and/or other conditions that may exist in the ESP as positioned in a bore to pump the fluid.

Fluid and pump relationships can be multi-variable and can include behaviors that do not necessarily trend because various forces may result in different behavior. For example, as temperature increases due to viscous heating, a drop in viscosity can make the fluid easier to pump such that there may be less drag on certain stages of a multiple stage ESP. Various factors such as inlet pressure, outlet pressure, orientation with respect to gravity, heat transfer from a hot electric motor to fluid passing by the electric motor, etc. can contribute to an energy balance.

As to operation of an ESP, known information can be power supplied to the ESP during operation. Additional known information can be flow rate of produced fluid at a surface location (e.g., a surface flow meter, state of an adjustable choke, etc.). Various other types of information may be known, some of which may be static and some of which may be dynamic.

In an example where an ESP includes temperature sensors, such information can be utilized in an energy balance or energy balances. As mentioned, information as to temperature of fluid being pumped can be related to work performed by the ESP. Work performed upon fluid can be related to factors such as wear of one or more components of an ESP, which may, in a control system, be utilized to operate an ESP in a manner that can balance pumping and wear, for example, along with one or more other factors, which may include efficiency. For example, an ESP may be operated in a manner that aims to achieve an acceptable or optimal balance between pumping, wear and efficiency. In FIG. 7, such a balance may be achieved via the drive 770 and/or via the schedule 771, which can instruct the drive 770.

In FIG. 7, the adaptive model 710 can be a digital twin of the ESP system 760 or at least a portion thereof. A digital twin can be a computational framework tool that can be utilized for one or more purposes. A digital twin can be a dynamic digital twin in that it can adapt to information received, whether from a physical twin (e.g., an installed ESP) and/or from one or more other ESPs and/or one or more other sources (e.g., drive information, cable information, etc.).

A digital twin may be utilized, for example, as to product design and engineering. In such an example, a digital twin may be enhanced through instantiation of one or more sensors in the digital twin. Such one or more sensors may be selected as to type of sensor and location of sensor, as well as, for example, under what conditions such a sensor may operate. Such an enhanced digital twin may provide for an uncertainty analysis to determine what type of sensor, where to place the sensor and under what conditions sensed information can act to reduce uncertainty as to operation of an ESP. As an example, where a digital twin validates operation of one or more sensors, if an actual sensor fails (e.g., becomes unreliable for one or more reasons), the digital twin may utilize a computed sensor as a substitute, which may be based on information from one or more other sensors. For example, where an ESP includes ten temperature sensors, where at least some of the temperature sensors are located based on a recommendation from a digital twin, upon failure of one of those sensors, the digital twin may operate to fill-in information that would have been sensed by that sensor under normal operation.

As another example, additionally or alternatively, a digital twin may provide information that can be utilized to assess operation of one or more sensors. For example, a digital twin may be utilized to track differences between sensed information from actual sensors and sensed information of digital, computed sensors of the digital twin. Where a difference exceeds a limit for an actual sensor as compared to a corresponding sensor of the digital twin, the sensed information from the actual sensor may be processed in a particular manner, for example, to ignore or to modify sensed information from the actual sensor.

As an example, a digital twin can be utilized for performing simulations of operational scenarios. Such simulations may be utilized, for example, to determine a schedule such as the schedule 771. As an example, a digital twin may be utilized in real-time to modify a schedule, for example, responsive to sensed information, etc. As mentioned, a schedule may aim to balance various factors (e.g., pumping, wear, efficiency, etc.).

As an example, a computation framework that includes data interfaces for receiving sensed information and for outputting control information and/or other information can include one or more sets of physical models for generating one or more digital twins of one or more components of an ESP system. Some examples of models include cable, motor electromagnetics, motor thermal, well hydraulics, reservoir, and pump. In a workflow, various models can be co-instantiated with appropriate parameters and parameter values and utilized for co-simulation (e.g., at least some amount of model interdependence, etc.) so that information (e.g., state variables, etc.) can be exchanged between models where a solver aims to seek convergence of each model appropriately, for example, with respect to time such that a solution is a dynamic solution that can mirror dynamic behavior of an ESP system. As an example, inputs can include sensed information from an installed ESP system during one or more transient operating scenarios such as, for example, start-up, shut-down, speed change, gas change, water change, hydrocarbon fluid change, temperature change, pressure change, solids change, viscosity change, etc.

As an example, a computational framework for generating and maintaining a digital twin can include local and/or remote resources with respect to one or more sites where an ESP or ESPs are installed. As an example, models may be instantiated on different computational platforms. For example, a drive can include resources for instantiation of a drive model that can determine power supply conditions, receipt of information conditions (e.g., for information transmitted via a cable), resonance conditions in a cable, etc.

As to particular models and relationships therebetween, consider, for example, a motor electromagnetics model where shaft torque is matched with a pump model input drive torque; where a well reservoir flowrate is an input to a motor thermal model (e.g., for heat transfer from the motor to the fluid, etc.) and to a pump model and to a well hydraulics models; and where motor thermal model temperatures are input to the motor electromagnetic model. Such an approach can include one or more global balances. For example, consider a global mass balance, a global energy balance, etc. In such an example, mass and/or energy balances may be determined with respect to different locations in a well that includes at least one ESP. As to energy utilized to operate one or more ESPs, energy balances may include power supply, which may be a power grid, a gas turbine power generator, or other type of power source that supplies power to one or more drives that supply power to one or more ESPs.

As to an ESP cable model, such a model can include equations to predict three phase voltage drop across an ESP cable. For example, consider the motor terminal voltage, Vabc'=Vabc−Zcable*Iphase where Vabc is the drive voltage, Zcable is the cable impedance and, Iphase are the phase currents.

As dynamics of ESP motor electromagnetics tend to be of a smaller time scale than those of various other parts of an ESP system, a steady-state motor electromagnetics model may be suitable for implementation in a dynamic modeling framework that generates one or more digital twins. Such a model may be developed, for example, using an IEEE equivalent circuit which can predict that the motor output torque, $T_{em}$ n is:

$$T_{em}=3*I'^{2}_{r}*R'_{r}/W_{s}*s$$

where $I'_r$ is the rotor current, $R'_r$ is the rotor resistance, $w_s$ is the synchronous angular speed, and s is the slip.

A motor electromagnetics model may also predict the segregated losses in a motor, for example: lamination core losses in a stator and rotor, stator winding losses, and viscous shearing losses in a rotor-to-stator "air" gap. Such segregated motor losses can be utilized in a time transient, lumped-parameter motor thermal model of a motor using an energy balance at nodes internal to the motor and at nodes which interface to the external well annulus to predict thermal gradients throughout the motor.

As well hydraulics model can be based on the transient solution of the compressible Navier-Stokes equation, which may be reduced to one dimension (e.g., along x as a wellbore axial dimension) for a single-phase fluid flowing in the well casing below an ESP, tubing above the ESP, and an annulus between the well casing and the tubing. Below is an example of such a Navier-Stokes equation:

$$\frac{\partial u}{\partial t} = \frac{B}{\rho\rho_a}\frac{\partial \rho}{\partial x}\ u\frac{\partial u}{\partial x} + \frac{1}{\rho}(2\mu+\lambda)\frac{\partial^2 u}{\partial x^2}\ g\sin\theta\ k_1 u\ k_s u^2$$

where u is the fluid velocity, B is the fluid bulk modulus, ρ is the fluid density, μ is the dynamic viscosity, λ is the fluid bulk viscosity, g is the acceleration due to gravity, θ is the well deviation, and $k_1$ and $k_2$ are fluid friction coefficients.

In a reservoir model, transient radial flow in porous reservoir rock surrounding a well casing can be modeled in a radial dimension, for example, using the diffusivity equation:

$$\frac{\partial p}{\partial t} = \frac{\kappa}{\phi\mu C_t}\frac{1}{r}\frac{\partial}{\partial r}\left(r\frac{\partial p}{\partial r}\right)$$

where p is the radial pressure gradient from the reservoir boundary to the wellbore, ϕ is the rock porosity, μ is the dynamic viscosity, K is the rock permeability, and $C_t$ is the total compressibility of the rock and fluid.

Submersible pump performance (e.g., head and shaft torque) versus shaft speed and flowrate can be modeled using four-quadrant pump characteristics to capture "normal" forward pumping (quadrant I) as well as turbine and energy dissipative modes (quadrants II, III, and IV). "Normal" as-new pump performance is usually given by the pump manufacturer for water at standard conditions. However, pump degradation due to wear (for example increased internal recirculation due to increased seal gaps) can be modelled using degradation factors for flowrate, torque, and head where for example the actual pump discharge flowrate:

$$Q_{act} = Q\left(1\ \ \frac{Q_{leak}}{100}\right)$$

where Q is the ideal flowrate and $Q_{leak}$ is the percentage of recirculation leakage.

Further, pump performance degradation due to actual well fluids—for example high viscosity fluids can be modelled using viscous degradation factors given for example by the Hydraulics Institute method. The Hydraulics Institute method uses degradation factors $C_Q$, $C_H$, and $C_\eta$ to determine the viscous flowrate, head, and efficiency ($Q_{vis}$, $H_{vis}$, and $\eta_{vis}$) from the ideal water flowrate, head, and efficiency ($Q_w$, $H_w$, and $\eta_w$):

$$Q_{vis}=C_Q \times Q_W$$

$$H_{vis}=C_H \times H_W$$

$$\eta_{vis}=C_\eta \times \eta_W$$

For various reasons such as, for example, harshness of downhole environment, remoteness of installation, cost, technology, etc., an ESP system may have relatively few sensors. As an example, an ESP system can include surface sensors that monitor various parameters such as electrical drive frequency, three-phase current, and three-phase voltage. Additional types of surface sensors include surface flow sensors, which can monitor various parameters such as wellhead pressure and temperature.

As to downhole sensors, an ESP system may include sensors that can monitor pump intake pressure and temperature; pump discharge pressure and temperature; and motor oil temperature. Known system parameters and sensor monitored state variables (e.g., pressures and temperatures) tend to be too sparse to allow for practical and reliable calculations of unknown system state variables (e.g., using a forward solution of a system co-simulation).

For one or more of the foregoing reasons, a system can include instructions and resources that can implement one or more system identification methods that can estimate unknown state variables (e.g., pump flowrate) and parameters (e.g., well fluid viscosity), which may not be available directly via a sensor or sensors installed in an ESP system deployed downhole.

In an example embodiment, uncertain fluid parameters of fluid density; $\rho$, dynamic viscosity, $\mu$; heat capacity, $C_p$; and thermal conductivity, k; the uncertain pump internal leakage due to wear, $Q_{leak}$; and unknown state variable of pump flowrate can be estimated using a parameter identification technique of model inversion.

In such an example, measured signals can be ESP drive frequency, drive current, drive voltage, wellhead pressure, pump intake pressure and temperature, pump discharge pressure and temperature, motor oil temperature, and fluid arrival time at the wellhead during ESP start-up as indicated by a rapid change in wellhead pressure. FIG. 10, described further below, includes a table 1000 with examples of model equations that can define relationships between unknown variables of fluid density, viscosity, heat capacity, thermal conductivity, pump leakage, and pump flowrate and various measured sensor data. In an oil-water flow the fluid variables of density, viscosity, heat capacity, and thermal conductivity can be reduced to functions of oil API gravity and the water cut of the flow.

As an example, an inverse problem can be cast through equations and instructions that aim to find a best set of model parameters and state variables, "m" such that approximately d=G(m) where G is represents the governing physical models that describe an explicit relationship between observed data, d and model parameters and state variables, m.

As to a solver, a framework such as the DYNARDO OPTISLANG™ (DYNARDO (Dynamic Software and Engineering) GmbH, Germany) provides a solver that can be used to solve such model calibration or inversion problems using one or more of various methods of optimization to minimize error between data predicted by a co-simulated set of models and observed or measured sensor data.

The OPTISLANG™ framework provides for conducting sensitivity analyses, multidisciplinary optimization, robustness evaluation and reliability analyses. Such a framework may be implemented to, for example, quantify risks, identify optimization potential, improve product performance, secure resource-efficiency, reduce time to market, etc.

The OPTISLANG™ framework can be implemented to automatically identify relevant input and output parameters and quantify forecast quality, for example, with adjuncts of Coefficient of Prognosis (CoP) and/or Metamodel of Optimal Prognosis (MOP). A predictable prognosis quality can provide for efficient optimization. As an example, a "no run too much" approach can be implemented to minimize solver calls where, as a consequence, optimization tasks involving a large number of variables, scattering parameters as well as non-linear system behavior may be solved.

The OPTISLANG™ framework can be implemented to automatically select various appropriate algorithms, such as, for example, gradient methods, genetic algorithms, evolutionary strategies or Adaptive Response Surface Methods. As an example, various methods of optimization and stochastic analysis can be combined in regard to a particular task or tasks.

As an example, the adaptive model 710 may be adaptive in a state-based manner (e.g., as a state machine). As an example, the adaptive model 710 may include a state space for an ESP system and state spaces for individual components and/or combinations of components of an ESP system.

In the example of FIG. 7, the adaptive model 710 may be a sensor-based model, for example, with respect to downhole sensors and/or surface sensors that may be associated with an ESP system and/or a downhole environment.

In the example of FIG. 7, the ESP system 760 includes the drive 770 and optionally one or more sensors 775, which may include one or more downhole sensors and/or one or more surface sensors. As shown, the drive 770 may operate according to the schedule 771. For example, the schedule 771 may be coordinated with one or more operations in the field, cost of power supplied to the drive 770, quality of power supplied to the drive 770, lifetime of one or more components of the ESP system 760, etc.

As shown in FIG. 7, the schedule 771 may be operatively coupled to receive input and/or to transmit output for the adaptive model 710. For example, the schedule 771 may be or include a state-based schedule that can inform the adaptive model 710 when a state changes or states change, have changed or will change. As an example, the adaptive model 710 may alter the schedule, for example, based at least in part on a health assessment of one or more components of the ESP system 760, a predicted lifespan or end-of-life estimation of one or more components of the ESP system 760, etc.

As an example, the drive 770 may be operatively coupled to one or more of a line filter (e.g., a load filter, etc.), an isolation transformer or other circuitry, which may be represented at least in part via the adaptive model 710 (e.g., by a module, etc.). In the example of FIG. 7, the drive 770 is operatively coupled to one or more cables to power at least one electric motor of the ESP system 760. The one or more cables and the at least one electric motor may be represented at least in part via the adaptive model 710.

As an example, the adaptive model 710 may operate based on information from the drive 770. For example, the drive 770 may provide information as to a change in power supplied to the drive 770, quality of power supplied to the drive 770, temperature of the drive 770, voltages of the drive 770, currents of the drive 770, resistances of the drive 770, etc.

As an example, the adaptive model 710 may operate based on information from the one or more sensors 775. For example, consider a downhole sensor such as one or more of the sensors of the gauge of Table 1. As an example, a sensor may sense temperature, a sensor may sense pressure, a sensor may sense vibration (e.g., acceleration), a sensor may sense position, a sensor may sense location, a sensor may sense voltage, a sensor may sense current, a sensor may sense resistance, etc.

As an example, the adaptive model 710 of FIG. 7 may be used to assess the health of one or more components of the ESP system 760. In such an example, the health of an electric motor, a pump or other component may be tracked following changes in state and/or load conditions at one or more points or spans of time.

As an example, loading of the ESP system 760 can change dramatically, especially as a result of gas-liquid slugging, where the fluid density can change by an order of magnitude for one or more periods of time, which may last seconds, minutes or even hours. Such changes may result in one or more state transitions. In such an example, sensor information may be received by a computing system to identify one or more ESP system states and/or component states, which may allow for assessment of health of one or more components and/or the ESP system, prediction of a lifespan, etc.

As an example, non-linear and un-symmetric conditions of a line filter (e.g., a load filter, etc.), a transformer, a cable, and a stator may be measured and used to generate a motor bulk impedance model that includes a bulk leakage inductance, a bulk serial stator resistance and a motor magnetization inductance matrix. In such an example, the adaptive model 710 may include features for generation of the motor bulk impedance model.

The adaptive model 710 of FIG. 7 may, for example, be updated on a continuous basis and/or a periodic basis. Updating may be, for example, responsive to a change in a measured value, a schedule value, etc. As an example, a system may operate to continuously update to an adaptive model, for example, based at least in part on electrical measurements of multi-phase voltages and currents input to an electric motor of an ESP system. In such an example, the system may operate to provide a comprehensive health assessment of the ESP system and optionally predictions as to life expectancy of one or more components of the ESP system.

As an example, a system can provide for health monitoring and predicting useful remaining life of one or more components of an ESP system. In such an example, the system may account for non-idealities of a line filter (e.g., a load filter, etc.), an isolation transformer, an unsymmetrical cable, and/or asymmetry in an electrical motor. In such an example, an adaptive model may be implemented that is updated by monitoring ESP parameters such as temperature, fluid flow, and fluid composition, which may be provided by one or more pieces of downhole monitoring equipment.

As an example, a system may provide information as to degradation in performance of one or more pump stages, failure of one or more bearings, etc. As an example, such information may be based at least in part on a mechanical vibrational spectrum of a downhole pump and its interaction with loading of an electrical motor, which can depend on how the pump is mounted. As an example, such information may be based at least in part on assignment of particular resonant modes to one or more sets of bearings in an electric motor, a protector and/or one or more pump stages. As an example, a system can include sensors for making measurements that may be distributed along an electric motor, a protector and/or one or more pump stages. Such information may be used to refine an adaptive model such as, for example, the adaptive model 710 for purposes of state identification, state transitioning, predictive health monitoring, etc.

As an example, a method can include estimating equipment health and predicting life expectancy of one or more components of an ESP system utilizing a model of the ESP system, which may be complimented with downhole measurements such as measurements of motor phase currents and voltages, pressures, temperatures, vibrations, flowrate, fluid composition, etc.

As an example, a method for determining remaining useful life of one or more components of an ESP system may include correlating multiple input signals from sensors at surface as well as downhole sensors, mounted on and around an ESP system, for example, to assess via a model health of an electric motor and/or pump components (e.g., bearings, seals, electrical isolation weakness, etc.).

In FIG. 7, the method 780 includes a reception block 782 for receiving sensor information from at least one sensor disposed in a downhole environment that includes artificial lift equipment operatively coupled to a surface controller; an analysis block 784 for analyzing information; and an output block 786 for outputting information to the surface controller, which may be implemented, for example, for controlling an artificial lift system via an adaptive model of at least a portion of the artificial lift system based at least in part on a portion of the sensor information. In such an example, the method 780 may provide for state identification, which may be associated with a health status and/or a lifespan of a piece or pieces of equipment.

As shown in FIG. 7, the method 780 may be associated with various computer-readable media (CRM) blocks 783, 785 and 787. Such blocks generally include instructions suitable for execution by one or more processors (or cores) to instruct a computing device or system to perform one or more actions. As an example, a single medium may be configured with instructions to allow for, at least in part, performance of various actions of the method 780. As an example, a computer-readable medium (CRM) may be a computer-readable storage medium that is non-transitory and that is not a signal and not a carrier wave.

In FIG. 7, the system 791 may include one or more computers 792, one or more storage devices 795, one or more networks 796 and one or more sets of instructions 797. As to the one or more computers 792, each computer may include one or more processors (e.g., or processing cores) 793 and memory 794 for storing instructions, for example, executable by at least one of the one or more processors. As an example, a computer may include one or more network interfaces (e.g., wired or wireless), one or more graphics cards, a display interface (e.g., wired or wireless), etc. As an example, data may be provided in the storage device(s) 795 where the computer(s) 792 may access the data via the network(s) 796 and process the data via the module(s) 797, for example, as stored in the memory 794 and executed by the processor(s) 793. As an example, a computer-readable storage medium may be non-transitory and not a signal and not a carrier wave. Such a storage medium may store instructions and optionally other information where such instructions may be executable by one or more processors (e.g., of a computer, computers, a controller, controllers, etc.).

Figure 8:
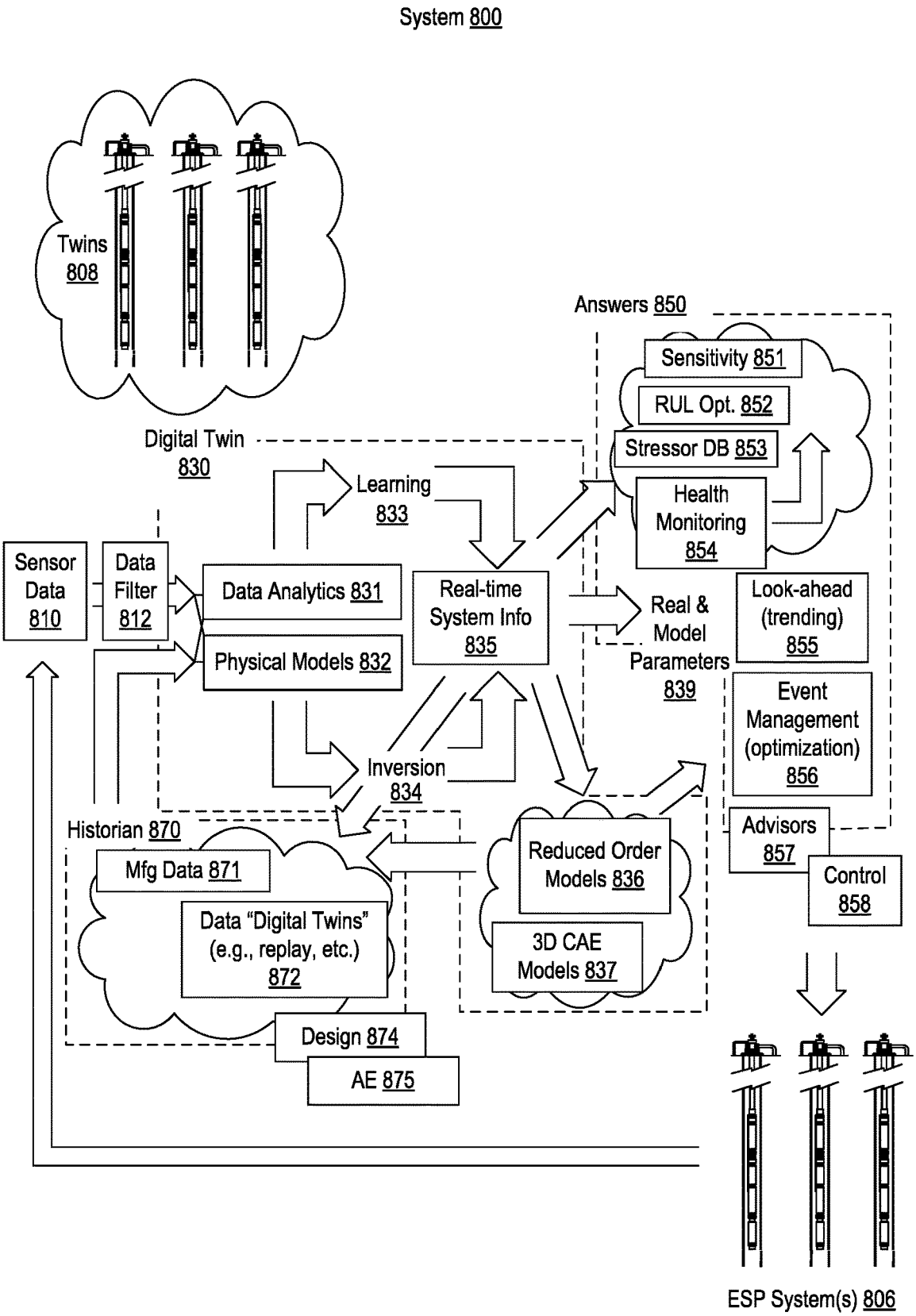
FIG. 8 illustrates an example of a system.

FIG. 8 shows an example of a system 800 that includes various frameworks that are operatively coupled along with interfaces for receipt of information and transmission of information where the system 800 can, for one or more ESP systems 806, generate one or more digital twins 808 of the one or more ESP systems 806. While ESP systems are illustrated, the system 800 may be utilized for one or more artificial lift systems such as one or more of gas lift systems, rod pumping systems and ESP systems.

As shown in the example of FIG. 8, the system 800 includes a sensor data block 810 that provides sensor data (e.g., at least from one of the one or more ESP systems 806, etc.) to a digital twin framework 830 where information generated via one or more digital twins 808 may be output to an answers framework 850, which can include one or more features that operatively couple to one or more systems. As shown, the answers framework 850 can output information via one or more interfaces as represented by the advisors block 856 and the control block 857, which may be operatively coupled to one or more pieces of field equipment at a site or sites where one or more ESPs are installed, operated, etc. (see, e.g., the one or more ESP systems 806).

In the example of FIG. 8, the system 800 includes a historian framework 870, which can receive information and output information. As shown, the historian framework 870 can receive information from the digital twin framework 830 and output information to the digital twin framework 830.

As shown, the digital twin framework 830 includes a data analytics block 831, a physical models block 832, a learning process 833, an inversion process 834, a real-time system information block 835, a reduced order models block 836 and a 3D computer aided engineering (CAE) models block 837. As shown, the digital twin framework 830 can output real and model parameters 839 (e.g., parameters and values thereof). A real parameter can be a sensed parameter where a sensor can provide a direct value for the parameter (e.g., a sensor that measures values of a state variable) whereas a model parameter may be determined indirectly via computations. As to a model parameter, consider a model implemented sensor (e.g., for state variable measurement, etc.) that is positioned at a particular location in one of the one or more ESPs 806 (e.g., as installed in a well) where such a parameter can have a computed parameter value (e.g., a computed sensed value) that may be utilized by one or more control procedures for control of the one of the one or more ESPs 806. In such an example, the corresponding digital twin ESP 808 may be considered to be an enhanced ESP (e.g., the digital twin includes a sensor that is not included in the physical twin).

As to the answers framework 850, in the example of FIG. 8, it includes a sensitivity block 851, a remaining useful life (RUL) optimization block 852, a stressor database block 853 (e.g., for stress related wear due to conditions, cycles, etc., which can be a database of information such as a degradation database), a health monitoring block 854, a look-ahead block 855 (e.g., a trending block, which may be operatively coupled to one or more schedules for operation of one or more of the one or more ESP systems 806, etc.), an event management block 856 (e.g., optionally with optimization capabilities), the advisors block 857 and the control block 858.

As to the historian framework 870, in the example of FIG. 8, it includes a manufacturer data block 871 (e.g., a manufacturer or manufacturers database), a digital twins data block 872 (e.g., a digital twins database), a design block 874 and an AE block 875.

In the example of FIG. 8, the reduced order models block 836 may optionally output one or more reduced order models (e.g., lightweight models) for implementation at another location by one or more pieces of equipment. For example, consider a controller, a processor, etc., that includes an operating system and memory that can execute processor executable instructions to instantiation and utilize a reduced order model for purposes of control. In such an example, consider a drive, a gauge, or other on-site equipment that can implement such a reduced order model. As the system 800 is dynamic, the digital twin framework 830 may generate, update, close, etc. one or more reduced order models during operation of one or more of the one or more ESP systems 806. For example, where a more accurate or lighter weight reduced order model is generated, that reduced order model may be automatically deployed for execution and use by one or more pieces of field equipment.

As shown in FIG. 8, the digital twin framework 830 can output information to the features 851, 852, 853 and 854 of the answers framework 850, which may pertain to sensitivity of one or more of the one or more ESP systems 806 to a change in an operational parameter (e.g., a change in a parameter value or values), may pertain to health monitoring of one or more of the one or more ESP systems 806.

As shown in FIG. 8, the digital twin framework 830 can output information to the historian framework 870, which can include information sufficient to instantiate a digital twin (e.g., for future use, for simulation, for product development, for field analysis, etc.).

As mentioned, an ESP may include temperature sensors that can generate sensor data that can be, per the sensor data block 810, input to the digital twin framework 830. In such an example, a data filter block 812 may be implemented for purposes of handling data and performing one or more operations on such data (e.g., cleansing, formatting, collating, etc.). As to the data analytics block 831, it may process the temperature sensor data for purposes of learning per the learning process 833 and/or to perform one or more physical model based inversions per the physical models block 832 and the inversion process 834. Such processes 833 and 834 can provide, as output, real-time system information, which, as mentioned, may be utilized for controlling one or more ESP systems such as one or more of the one or more ESP systems 806. Where control is implemented, a loop can be formed where sensed information from temperature sensors is received by the digital twin framework 830. In such an example, a digital twin of one of the ESP systems (or more than one), may be made to be more accurate, particularly where transients may occur as transient operations can allow for dynamic behavior modeling. A dynamic digital twin can be more valuable than a static dynamic twin as a dynamic digital twin can have an ability to track an unmeasured dynamic (transient) that occurs in real-time during operation of an ESP system. In such an example, a digital twin may be a real-time controller that responds in real-time to control operation to reduce an unwanted transient condition from, for example, runaway to undesirable operation state, which may require shut-down and/or risk damage to one or more physical components of the ESP system. In such an example, the digital twin can be more complete than its corresponding physical twin (e.g., consider an enhanced digital twin with features beyond the physical twin). In the example of FIG. 8, the system 800 can include capabilities for control, which can include transmitting information to a surface controller that is part of or operatively coupled to one or more ESP systems (e.g. or other artificial lift systems). As to the historian framework 870, one or more of the data digital twins 872 may be utilized in forward modeling, for example, for offline simulations (e.g., to understand better aspects of scheduling, product development, etc.).

As mentioned, output of the digital twin framework 830 may be utilized for quality control purposes. For example, output of the digital twin framework 830 may include operational parameter values, sensed parameter values, etc. that can be compared directly to corresponding parameter values from one or more of the one or more ESP systems 806. In such an example, the digital twin framework 830 can allow for alarm settings where one or more alarms are triggered where a deviation beyond a limit occurs. Such an alarm may call for interrogation of both the digital twin and the corresponding physical twin to determine which one is causing the deviation in a detrimental manner (e.g., did the digital twin fail by outputting an unrealistic parameter value or is something amiss with the physical twin).

As explained with respect to the system 800, a "live" model or "digital twin" can be generated based at least in part on sensed information and utilized in a workflow encompassing one or more of equipment design, installation design, and operation of electrical submersible pumping system. In this context, a "live" model may, for example, include information based on time series sensor data acquired during operations. One or more models may be continuously updated in an operations "online" environment and, for example, used by one or more of off-line consumers (e.g., via the historian framework 870), such as design (see the design block 874) and applications engineering (AE) functions (see the AE block 875), and on-line consumers, such as health management (see the block 854), advisors (see the block 857) and controllers (e.g., one or more surface controllers, etc.; see the block 858).

As explained, an electrical submersible pump system can be deployed in a well and can include a variety of components depending on the particular application or environment in which it is used. As to a pump section or sections, stages can be characterized by angle of flow passages in impellers (e.g., and/or diffusers). As an example, one or more stages may be radial flow, mixed flow, or axial flow. As an example, a net thrust load, e.g. downthrust load, resulting from rotation of the impellers may be resisted by a bearing assembly, which may be in a motor protector.

A well can include a wellbore drilled into a geological formation that includes for example a desirable production fluid, such as petroleum. A wellbore may be lined with a tubular casing. Perforations may be formed through a wellbore casing to enable flow of fluids between the surrounding formation and the wellbore. A submersible pumping system can be deployed in a wellbore by a deployment system that may have a variety of configurations. For example, a deployment system may include tubing, such as coiled tubing or production tubing, connected to a submersible pump by a connector. Power may be provided to the submersible motor via a power cable. The submersible motor, in turn, powers submersible pump which can be used to draw in production fluid through a pump intake. Within a submersible pump, impellers are rotated to pump or produce the production fluid through, for example, tubing to a desired collection location which may be at a surface of the Earth.

Referring generally to FIG. 8, an ESP digital twin workflow for the design, installation and/or operation of an ESP may be implemented. The ESP digital twin may include an integrated multi-physics, multiscale, probabilistic simulation of an individual ESP system that uses physical models, as-built manufacturing data, time series sensor data from the installed system, and ESP fleet operations history to mirror the operations and life of its physical twin.

For example, an ESP digital twin workflow can includes implementing the historian framework 870, the digital twin framework 830, and an answers framework 850. The historian framework can include the manufacturing data 871 and the digital twins data 872. The digital twins data 872 may include the segment data 873 (e.g., for one or more well segments, etc.), one or more design engineering functions and data 874, and one or more applications engineering (AE) functions and data 875. The historian framework 870 may be disposed in a cloud-computing environment (e.g., consider the AZURE® framework marketed by Microsoft Corporation, Redmond, Wash.). In some embodiments, the historian framework 870 may be local to a user.

As to the digital twin framework 830, it may include the data analytics block 831, the physical models block 832, the real-time (RT) system information block 835, a learning process 833, and an inversion process 834. As an example, the learning process 833 may act on information from the data analytics block 831 to provide input to the RT system information block 835. The inversion process 834 may act on one or more of the physical models of the physical models block 832 to provide input to the RT system information block 835. As mentioned, the processes 833 and 834 can output state variable information for state variables that may not be directly measured via one or more sensors. Such an approach can provide for a fuller set of state variable information, beyond that which corresponds to directly measured state variables (e.g., via downhole and/or surface sensors). The processes 833 and 834 represent two different paths to arrive at state variable information based at least in part on sensed information (e.g., and optionally historical information as from the historian framework 870).

As an example, at least a portion of the digital twin framework 830 may be disposed in a cloud-computing environment. In some embodiments, at least a portion of the digital twin framework 830 may be local to a user. For example, in some embodiments, the reduced order models 836 and/or 3D CAE models 837 may be disposed in a cloud-computing environment. The reduced order models 836 and/or the 3D CAE models 837 may communicate data to the event management block 855 (e.g., via one or more networks, etc.).

The digital twin framework 830 may receive information from the historian framework 870 and receive information as sensor data per the sensor data block 810 from one or more downhole sensors and/or one or more surface sensors associated with one or more ESP systems (e.g., via one or more networks, etc.).

As an example, the stressor database 853 may interact with the health monitoring block 854 to provide input to the sensitivity block 851 and/or the RUL optimization block 852. As an example, at least a portion of the answers framework 850 may be disposed in a cloud-computing environment.

As an example, a digital twin workflow may implement a suite of simulation models that may be at various levels of scale that are overall sufficiently rich in detail and behavior to describe one or more ESP system-level responses. Such models may include physical models based on equations of physics, data analytical models based on machine learning from time series sensor data, or combinations of both.

As an example, downhole and surface sensors can collect time series data that may be used with the simulation models to produce a continuously updated ESP system state based on actual sensor data and virtual (computed) data determined from the simulation models. The number of sensor observations may be inadequate to enable a closed-form identification of a totality of system parameters (inputs such as geometry, fluid and material properties, etc.) and state variables (responses such as pressure, flowrate, voltage, and etc.) for a complex multi-physics suite of system models.

As an example, one or more system identification methods based on statistical or optimization techniques, for example, may be used to estimate unknown model parameters and responses (see, e.g., the processes 833 and 834). The result of such a system identification process can be a time evolving description of the system state or a digital twin based on measured and virtual data (e.g., computer generated data). Examples of sensor measurements used in ESP systems include, but are not limited to, surface voltages, currents, and power and downhole pressures, flowrates, temperatures, and vibration.

As an example, a digital twin model may use historian data to inform ESP simulations. The historian data may include as-built equipment data such as pump and motor performance curves, ESP string vibration data, and actual bearing running clearances corresponding to a specific physical ESP. The historian data may also include ESP fleet failure and operational information that can be data mined to identify the historical response of installed ESPs to certain operating conditions. For example, this historical response could include the rich historical digital twin models (e.g., time series system states) of many ESPs in the same field as the ESP for which a digital twin is currently being processed.

As an example, a rich time evolving ESP system digital twin may be used: 1) to update both Reduced Order Models (ROM) and/or higher order CAE Models, e.g. FEA or CFD models; and/or 2) for simulation of Answer Products such Health Monitoring, Remaining Useful Life (RUL) Optimization, operations Trending, and operations optimization for Event Management.

As an example, ROMs may be likened to reduced fidelity digital twins (e.g. response surfaces) that may be simulated by Answer Products in a demanding real time application such as closed-loop control of ESP operations much more quickly than could the parent Digital Twin model. The higher order CAE Models may simulate complex, 3D physics such as ESP rotordynamic behavior. In some embodiments, the CAE Models may be updated off-line to give virtual detail not present in the parent digital twin model. The time series records of the parent digital twin, the ROMs, and the CAE Models may be uploaded to the Historian for future data mining.

As an example, a digital twin workflow may be used in a cradle-to-grave manner spanning the ESP system lifecycle. For example, design engineering may use the digital twin information in the historian (rich digital twin, ROM, and 3D CAE models) to gain improved insight into ESP operating environments, to optimize component design and conduct virtual testing based on the response of historical digital twin models modified to simulate a new design features, to develop new ESP control strategies for specific operating environments, to develop improved physical models, and to develop rich insight into the root cause of failures leading to improved designs and improved ESP life models. Application engineering (AE) may use the digital twin information in the historian to optimize ESP equipment and trim selection for the projected mission profile of the specific installation based on objectives such as capital cost of the installation, ESP runtime, or rate of oil recovery. Answer products such as health monitoring and event management based on an evolving digital twin enable a "self-aware" ESP so that operations may control the ESP to optimally manage events such as start-up and gas-lock, give notification of impending failures or other important events, conduct virtual testing of proposed operational changes, and optimize RUL. The historical digital twin record may provide operations with rich insight into the operations history of the ESP fleet that can be used as context for currently running and evolving digital twins, as a basis for detailed forensics, and to develop improved operating guidelines.

One or more types of computing architectures may be used in the implementation of a digital twin workflow. Historian data (e.g., as-built manufacturing data and historical digital twins) may be remotely located and accessed by one or more users via a web-service interface. As an example, simulation to update one or more ROMs from each individual evolving digital twin model may also be performed locally and/or remotely from an individual installation wellsite or platform while simulation to update 3D CAE models may be performed remotely. As an example, simulation of health monitoring answer products may be performed locally and/or remotely; noting that dynamics of degradation processes may be on a relatively long time scale (e.g., weeks to months). As an example, simulation for event management of quickly evolving real-time events such as dead-head or gas-lock may be performed locally and/or remotely for each individual well or platform while optimization to improve operations may be performed, optionally in parallel.

Figure 9:
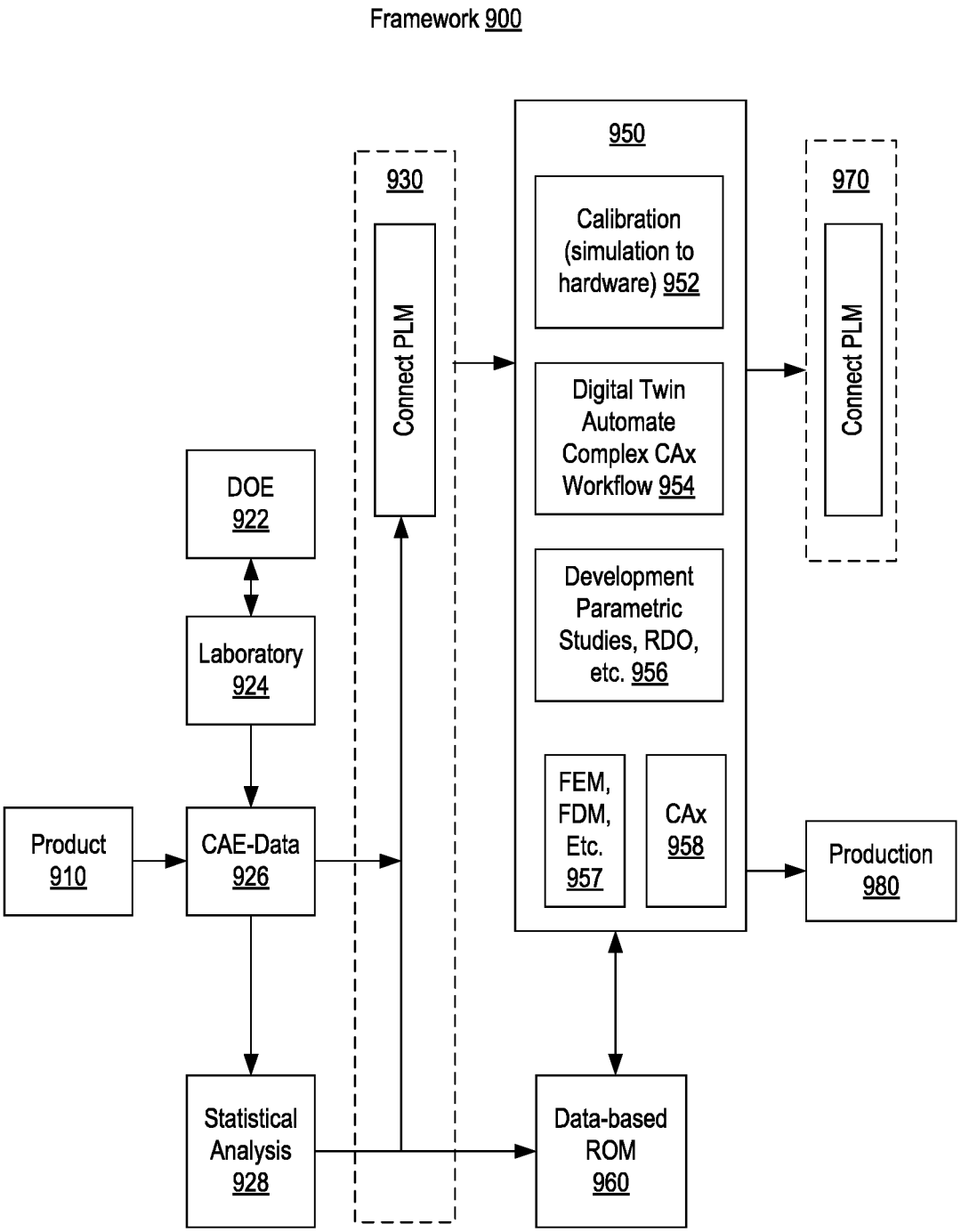
FIG. 9 illustrates an example of a framework.

FIG. 9 shows an example of a framework 900 that is implemented for a workflow that involves a product 910 as an input concept and a production product 980 as an output. As shown, various inputs design of experiments (DOE) 922, laboratory data 924, CAE data 926 and statistical analysis 928 can be generated and transmitted to one or more other components of the framework 900, for example, via a smart network data flow manager 930 (e.g., "Connect PLM" (product lifecycle management) in the OPTISLANG™ framework). As shown, information can be directed to a core set of services 950 and to a data-based reduced order model (ROM) block 960. In the example of FIG. 9, the core set of services 950 include calibration services 952, digital twin services 954 and development parametric services 956 as well as one or more Finite Element Method (FEM), Finite Difference Method (FDM) and/or one or more other types of numerical solvers 957 as well as one or more CAx types of tools 958 (e.g., CAD, automated CAD, etc.). As shown, information may be output to data management services 970 and may be output as to the production product 980.

In FIG. 9, the framework 900 may be implemented for a dynamic ESP system where physical models are included to model thermodynamics, electromagnetics, fluid dynamics, etc. and/or one or more other physical operational realities of a dynamic ESP system. As an example, the system 800 of FIG. 8 may be implemented utilizing one or more features of the framework 900 of FIG. 9.

As to ROMs, such models can be utilized for simulation and/or control, as explained with respect to the system 800 of FIG. 8. As an example, a digital twin may be represented at multiple levels using, for example, detailed comprehensive equations at a detailed level to a highly reduced order model (ROM) with associated equations at a level of lesser detail, where such lesser detail may be suitable for expedited decision making, control, etc., which may be, for example, real-time decision making, control, etc.

As an example, a detailed product simulation can be linked to sensor data to predict product parameters (e.g. condition of impellers and/or diffusers) where such predictions may be accurate enough to be capable of helping to optimize maintenance and/or operation. To fulfill the reaction time requirements from a digital twin, the fidelity of the simulation models may be reduced. One approach of ROMs can utilize a matrix condensation which is called "physics-based" ROMs, because the formula still includes the physics of how input variation affects response. Such reductions may be for linear systems; whereas, for non-linear systems, ROMs can be data-based ROMs. Such data-based ROMs can utilize functional models to approximate response surfaces, which can provide for considering the effect of input variations on the response variation based on a given sample set. As an example, for eld data as input or response, a statistics on structures (SoS) or other type of statistical analysis may provide for Field Metamodel of Optimal Prognosis (FMOP) which can be used to approximate signals, FEM solutions or geometric deviations. FMOP can provide for extended metamodeling, for example, from scalar values to fields in time and/or space. As an example, MOP may provide for descriptions of how scalar input variation can affect scalar output variation.

As to CAD framework integration, consider, as examples, one or more of CATIA, NX, CREO, and SOLIDWORKS. As to CAE framework integration, consider, as examples, one or more of ANSYS, ABAQUS, and AMESIM. As to various other frameworks, consider EXCEL, MATLAB, and PYTHON as some examples.

As mentioned, a reduce order model (ROM) may be a transient ROM (tROM). In generating tROMs, a digital twin can analyze transient behavior of an artificial lift system. For example, transient behavior may occur due to gas in fluid moving through a portion of an artificial lift system. Gas may respond to various forces via compression and expansion, which can cause vibrations or other time dependent signal responses (e.g., as acquired via one or more sensors, etc.). As an example, given sensed data for transient behavior, a digital twin may be utilized to generate one or more tROMs that model that transient behavior where, for example, such tROMs may be utilized for control and/or one or more other purposes that may benefit from rapidity of model execution (e.g., optionally in real-time). As an example, one or more tROMs may be stored in a database such as a database of a historian framework (see, e.g., the historian framework 870 of FIG. 8).

As to an ESP system, measured signals may be ESP drive frequency, drive current, drive voltage, wellhead pressure, pump intake pressure and temperature, pump discharge pressure and temperature, motor oil temperature, and fluid arrival time at a wellhead during ESP start-up as indicated by a rapid change in wellhead pressure. The physical relationships in the earlier described models can define the relationships between unknown variables of fluid density, viscosity, heat capacity, thermal conductivity, pump leakage, and pump flowrate and various measured sensor data. In an oil-water flow the fluid variables of density, viscosity, heat capacity, and thermal conductivity can be reduced to functions of oil API gravity and the water cut of the flow. In such an example, one or more tROMs may be output that can model transient behavior of the ESP system.

FIG. 10 shows a table 1000 with examples of physical behavior, sensor measurements, variables, and model equations. As shown, physical behaviors can include tubing viscous pressure drop, gravitational head, pump temperature rise, pump pressure rise, tubing filling and motor heat dissipation to an annulus. As shown, sensor measurements can include discharge and wellhead pressures, discharge and intake temperatures, discharge and intake pressures, fluid arrival time at a wellhead during startup, and motor oil temperature. As to variables, consider density, viscosity and flow rate as associated with tubing viscous pressure drop; density as associated with gravitational head; density, flow rate, heat capacity, and pump efficiency as being associated with a pump temperature rise where pump efficiency is a function of fluid viscosity, flowrate and pump leakage (e.g., seal leakage, etc.); density, viscosity, flowrate and pump leakage being associated with pump pressure rise; flowrate being associated with tubing filling; and density, flowrate, heat capacity, thermal conductivity and viscosity being associated with motor heat dissipation (e.g., to annulus fluid, etc.). As indicated in the table 1000, various equations and/or dimensionless numbers may be utilized to characterize, model, etc., various physical behaviors. As an example, models may be linked and, for example, co-simulated, co-inverted, etc.

Figure 11:
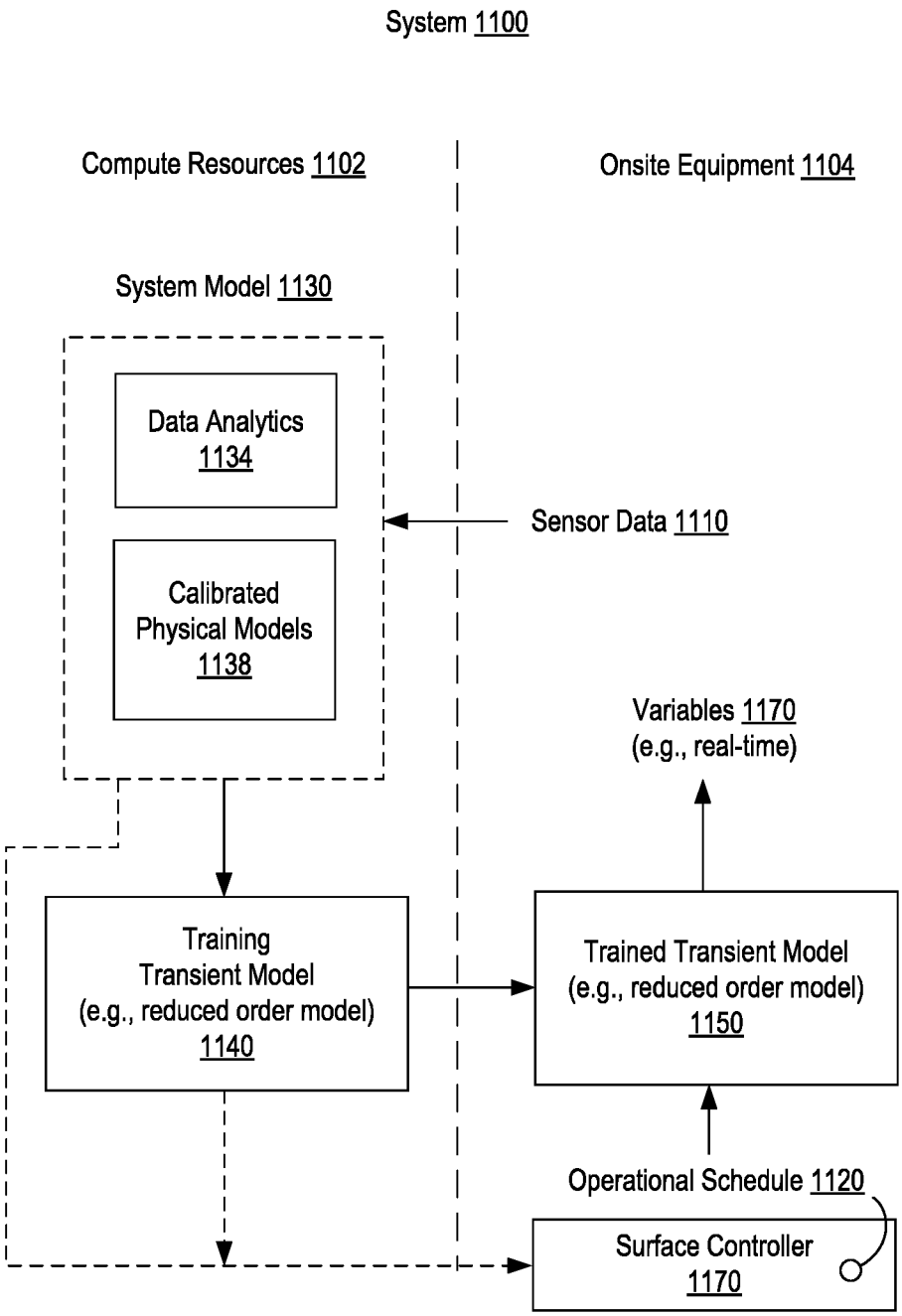
FIG. 11 illustrates an example of a system.

FIG. 11 shows an example of a system 1100 that includes compute resources 1102 and onsite equipment 1104 where the compute resources 1102 may be local and/or remote. As shown, sensor data 1110 can be acquired while onsite equipment 1104 operates according to an operational schedule 1120, which may provide for some amount of automated operation (e.g., responsive to pressure, temperature, flowrate, etc.). In such an example, the onsite equipment 1104 can be artificial lift equipment such as, for example, gas lift equipment, rod pumping equipment, and/or ESP equipment. As shown, the sensor data 1110 can be input to a system model 1130 (e.g., an adaptive system model) that can perform data analytics per a data analytics block 1134 and that can calibrate physical models per a calibration block 1138. Such features may be akin to the features of the adaptive model 710 of FIG. 7 and/or the digital twin framework 830 of FIG. 8.

In the example of FIG. 11, the system model 1130 can output information to a training block 1140 that can train a transient model, which may be a reduced order model. Output of the training block 1140 may be a trained transient model (e.g., a trained reduced order model) per the trained transient model block 1150. As shown, the trained transient model block 1150 may receive operational information as in an operational scheduled 1120 such that one or more trained transient models (e.g., tROMs) can be utilized to output one or more variables (e.g., values for state variables, etc.), optionally in real-time.

As illustrated in FIG. 11, the system model 1130 may output information to a surface controller 1170 that may operate according to the operational schedule 1120. As an example, one or more trained transient models as output by the training block 1140 may be transmitted to the surface controller 1170. As an example, the surface controller 1170 may include one or more processors and memory that can store processor-executable instructions, which may provide for implementing one or more tROMs as may be output via the system model 1130 and/or other resources operatively coupled thereto (e.g., consider a historian framework, etc.). As an example, the surface controller 1170 may generate one or more of the variables 1170, for example, for purposes of controlling one or more pieces of artificial lift equipment (e.g., a gas supply, a gas valve, a motor, a pump, etc.).

Figure 12:
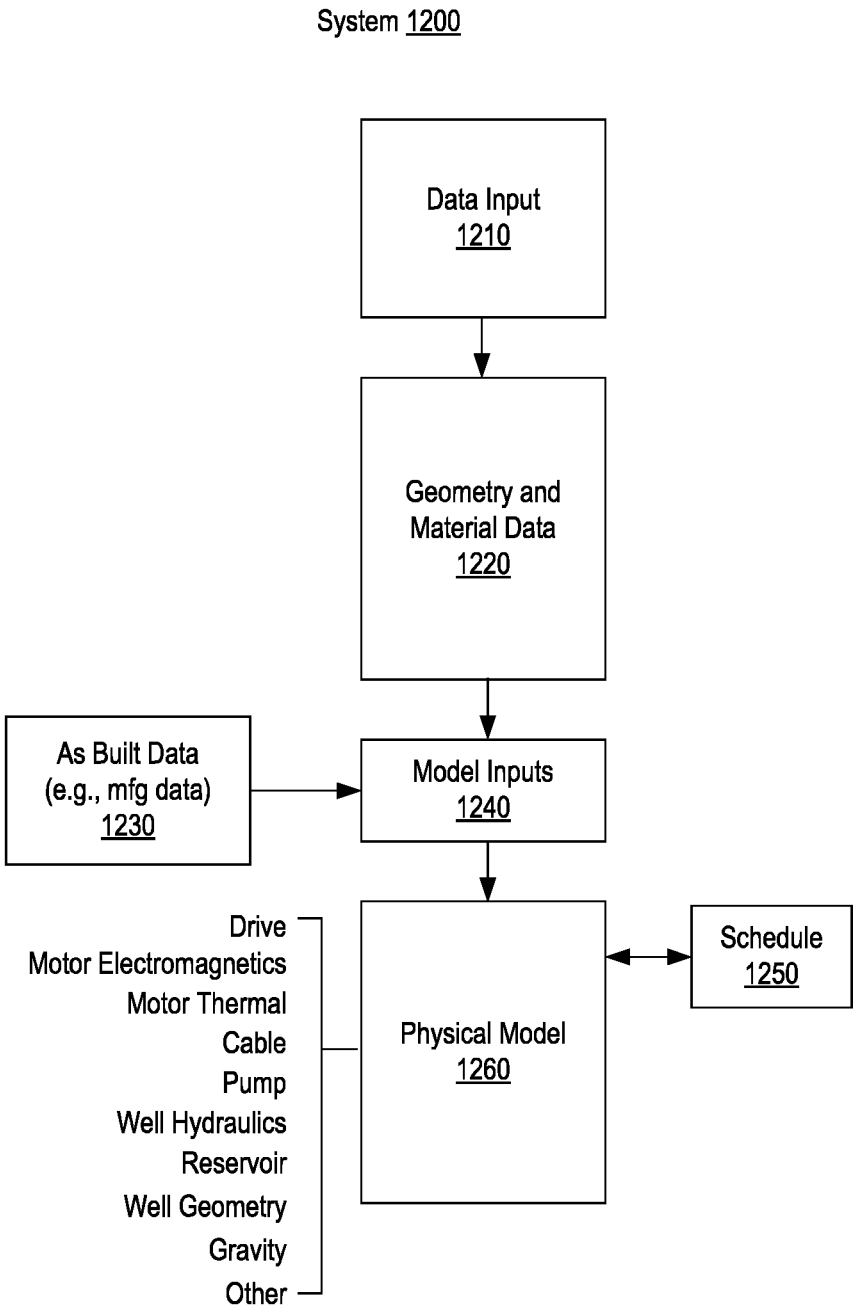
FIG. 12 illustrates an example of a system.

FIG. 12 shows an example of a system 1200 that includes a data input block 1210, a geometry and material data block 1220, "as built" block 1230, a model inputs block 1240, a schedule block 1250 and a physical model block 1260. In the example of FIG. 12, the system can analyze various types of data and provide analysis results as model inputs to one or more physical models per the physical model block 1260 where the physical model block 1260 may receive and/or output information to the schedule block 1250, which can provide for one or more operational schedules for operation of one or more artificial lift systems. As mentioned with respect to FIG. 11, an operational schedule may be stored in memory of a surface controller that is operatively coupled to one or more pieces of an artificial lift system. In the example of FIG. 12, the physical model block 1260 can provide at least in part for digital twin generation where a generated digital twin can correspond to a physical system that is specified at least in part by data of the as built block 1260 (e.g., manufacturer data, etc.).

Figure 13:
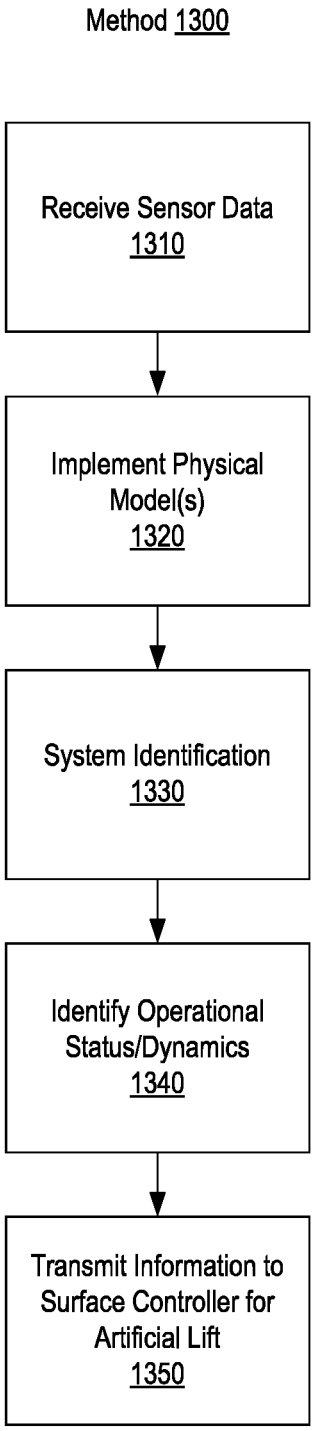
FIG. 13 illustrates an example of a method.

FIG. 13 shows an example of a method 1300 that includes a reception block 1310, an implementation block 1320, a system identification block 1330, an identification of operational status/dynamics block 1340 and a transmission block 1350 for transmitting information to a surface controller for artificial lift (e.g., artificial lift equipment operable at least in part via signals, commands, etc. output by a surface controller).

In the example of FIG. 13, the physical models of the implementation block 1320 may be utilized in an inversion process to output information, for example, per the system identification block 1330 to identify state variables and/or state variable values that provide for a status of an artificial lift system in a field operation as indicated per the identification block 1340. As mentioned, a digital twin framework can include features that can perform an inversion process such that a digital twin can represent (e.g., mirror, etc.) a physical twin. As an example, a digital twin can be a dynamic, real-time digital twin of a physical artificial lift system where the digital twin may optionally be an enhanced version of the physical artificial lift system (e.g., as to features, capabilities, etc.).

Figure 14:
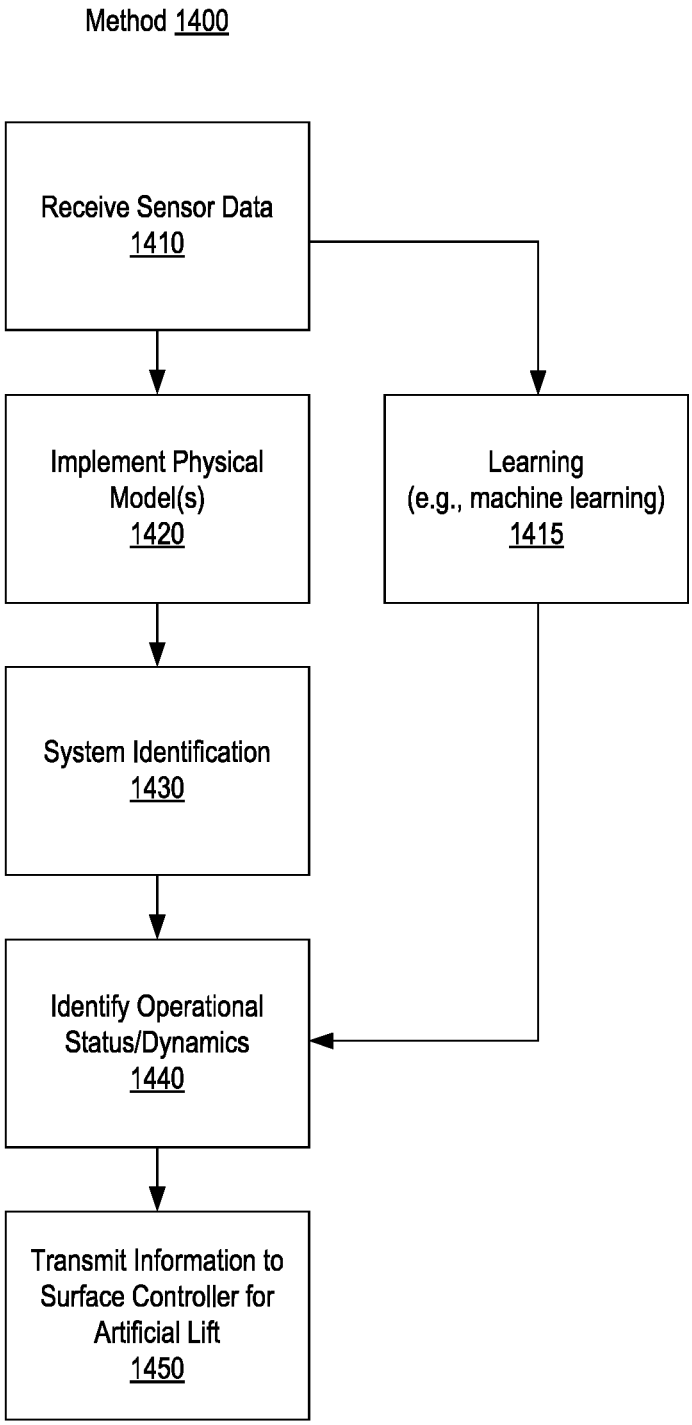
FIG. 14 illustrates an example of a method.

FIG. 14 shows an example of a method 1400 that includes a reception block 1410, a learning block 1415, an implementation block 1420, a system identification block 1430, an identification of operational status/dynamics block 1440 and a transmission block 1450 for transmitting information to a surface controller for artificial lift (e.g., artificial lift equipment operable at least in part via signals, commands, etc. output by a surface controller).

The method 1400 can operate akin to the method 1300 of FIG. 13 with the option of performing learning (e.g., machine learning) per the learning block 1415. Such learning can be data-based and may be characterized along a spectrum from black box to white box. As mentioned, sensor data can include time series data that may be of a resolution that provides a time scale that is amenable to processing via a learning process (e.g., one or more ANNs, etc.) to output information. In such an example, the information may be unavailable via inversion based on the one or more physical models or, for example, it may be available and be compared to the output of the learning process. As an example, the identification block 1440 can provide for comparing output of learning and output of inverting where such comparing may aid in determining what information to transmit to a surface controller for controlling artificial lift equipment. As an example, a learning process may output a state variable value that is more accurate (e.g., as to a digital twin) than a value of the inverting process (e.g., inversion process). In such an example, information transmitted to a surface controller may be based on the learning process output or, for example, a weighted combination of the learning process output and the inverting process output. In such an example, uncertainty may be output along with a value for a state variable where such uncertainty may be taken into account in determining what information to transmit. For example, values output by two different processes of a digital twin may differ where a value with a lesser uncertainty is utilized to determine what information to transmit to a physical artificial lift system.

As an example, a model calibration workflow may be implemented by a system such as the system 1200 of FIG. 12. Such a workflow can include populating a co-simulated set of models (see, e.g., the block 1260 of FIG. 12) with as-built manufacturing data (see, e.g., the block 1230 of FIG. 12) and data representing the actual measured geometry and performance of the specific hardware being modeled (see, e.g., the block 1220 of FIG. 12); predicting an initial set of system state variables by solving the model co-simulation using estimates for uncertain parameters such as fluid density $\rho$; dynamic viscosity $\mu$; heat capacity $C_p$; and thermal conductivity k; and the uncertain pump internal leakage due to wear $Q_{leak}$; using the DYNARDO OPTISLANG™ framework to iterate uncertain parameters using optimization algorithms (e.g., evolutionary, etc.) to minimize the error between the predicted state variables and the measured sensor data; and updating or evolving the calibrated model based on a subsequent set of measured sensor data.

As an example, a result of a system identification process (see, e.g., the blocks 1330 and 1430) can be a time evolving description of a system as a digital twin that is based on both measured responses and computed responses (e.g., via learning and/or inversion). In such an example, as applied to an artificial lift pump, model calibration can yield a time evolving prediction of information such as well composition (API gravity and water cut), state variable pump flowrate, and an estimate of the evolving leakage of a pump due to sand wear (see, e.g., particles in FIG. 6).

As mentioned, computed state variable values may be utilized to augment one or more measured sensor signals for the purposes of identifying operational events like low-flow and gas lock; trending for forecasting future operational behavior; and to manage and predict ESP equipment health such as Remaining Useful Lift (RUL) estimation.

Physical models used in a co-simulation workflow may be of such scale and fidelity that simulation times tend to be relatively lengthy and demand computing resources that may be remote from an actual artificial lift system installation. As an example, a co-simulated model workflow calibrated using a system identification process may be used to train a transient reduced order model, tROM (e.g., via the DYNAROM™ framework, ADAGOS, Ramonville-Saint-Agne, France), which can be a computationally lightweight representation of the full fidelity models. Such a tROM may be deployed to an edge computer located at a well installation for executing time sensitive simulation like control or event identification.

The DYNAROM™ framework provides for recurrent reduced order models where it can, from simulation and/or technical data, modelize non-linear dynamic processes and reduce instabilities that may be inherent in such phenomenological processes.

As an example, a workflow for instantiating a digital twin can include providing physical models for physical model co-simulation along with relatively detailed well completion, fluid, reservoir, and hardware data (e.g., from a design framework). As an example, component geometry and material property data and as-built hardware performance data (e.g., valve performance, pump performance, etc.) may be automatically instantiated from one or more enterprise databases, for example, based on bill of materials and serial numbers to generate a so-called "bill of analysis" for the provided physical models.

Referring again to the method 1300 of FIG. 13, instantiated physical models per the implementation block 1320 can be calibrated against a set of sensor signals per the reception block 1310, for example, using system identification techniques of the system identification block 1330 (e.g., model inversion to enable prediction of system state—or an "off-white" approach), to output operational information per the identification block 1340 where the transmission block 1350 may transmit information (e.g., the operational information and/or information based at least in part thereon) to a surface controller or surface controllers operatively coupled to a physical field installed artificial lift system.

As to the method 1400 of FIG. 14, as mentioned, system state information (e.g., one or more state variable values) prediction may be augmented using a learning process, which may be along a spectrum of black box to white box (e.g., black box or grey box). Such an approach can provide for a hybrid of calibrated physical models (see, e.g., the blocks 1420 and 1430) and machine learning (see, e.g., the block 1415) based at least in part on analytics of sensor signals (e.g., received sensor data of the reception block 1410). The method 1400 may be referred to as a "grey box" method.

As mentioned, a white box approach can be based on first principles (e.g. a model for a physical process from the Newton equations). As an example, a digital twin may be generated using a combination of approaches that may be characterized along a spectrum from black box to white box. As an example, a digital twin of an artificial lift system can be generated at least in part from measurements of behavior of the artificial lift system and, for example, inputs to the artificial lift system (e.g., operational control, other operations to a reservoir, etc.). As an example, one or more mathematical networks may be utilized to determine mathematical relations between inputs. As an example, a digital twin can be generated via a method that includes system identification processes that can differ as to their character along a spectrum from black box to white box.

An example of a grey box approach can include a model with a number of unknown free parameters (e.g., state variables) that can be estimated using system identification. In the realm of biology, consider the Monod saturation model for microbial growth, which includes a hyperbolic relationship between substrate concentration and growth rate that can be justified by a physical model of molecules binding to a substrate. Such a model does not completely explain underlying mechanisms of microbial growth and may be referred to as semi-physical modeling. As mentioned, in a black box approach, one or more system identification algorithms may be implemented that do not have, a priori, an underlying physical basis.

As an example, for nonlinear system identification, grey box modeling may assume a model structure a priori and then estimating model parameters. Such an approach can benefit from some knowledge of the form of the model (e.g., model structure). As an example, an analysis engine may implement one or more nonlinear autoregressive moving average models with exogenous inputs (e.g., NARMAX models) to represent a nonlinear system. A NARMAX approach may be utilized with grey box models, for example, where algorithms may be primed with known terms and/or with black box structure(s) where the model terms are selected as part of an identification procedure. In such an example, algorithms may select linear terms if the system is linear and nonlinear terms if the system is nonlinear, which provides for flexibility in identification.

As an example, a digital twin may commence as a generic or somewhat customized digital twin where, as data are received, the digital twin becomes more customized to mirror an actual physical artificial lift system. As an example, a computing system may generate a plurality of digital twins as corresponding artificial lift systems are implemented in the field. In such an example, various digital twins can become more individualized as field operations progress with respect to time.

As an example, digital twins may be utilized to differentiate and/or classify mechanisms that may, for example, be related to operational wear. For example, parameter identification may provide for various types of operational wear (e.g., one or more clearances, etc.). As an example, parameter identification may provide for fluid specific, recirculation, gas, and/or viscous heating determinations. As an example, a digital twin may provide for a chain of events that are related to degradation of one or more components.

As an example, a method can include providing a pre-calibrated model, commencing a digital twin on a first day of operation of an artificial lift system, acquiring data during the operation, inverting the data for values of one or more state variables, optimizing to reduce error between one or more operational metrics and one or more of such values, adapt the model to make the digital twin more accurately represent the artificial lift system (e.g., and/or enhance it beyond the features of the artificial lift system), and issue one or more alarms where error may indicate that an issue may exist with the digital twin and/or with the artificial lift system. In such a method, one or more types of information may be transmitted to a surface controller that is operatively coupled to artificial lift equipment.

As an example, a scenario may output information as to viscosity of fluid in an artificial lift system. For example, consider thermocouple sensor(s) in an ESP, a model or models of viscous heating over stages, data acquisition during operation of the ESP, inversion of at least a portion of the data utilizing a model or models to output information germane to viscosity/viscous heating, optimizing one or more operational parameters of the ESP, monitoring sensor data during operation for one or more trends (e.g., transients, etc.), analyze such sensor data via learning and/or inversion to output one or more values of state variables, and assess output as to one or more causes (e.g., fluid and/or mechanical). Such an approach may further transmit information to one or more surface controllers operatively coupled to one or more artificial lift systems. As an example, an uncertainty analysis may be performed based at least in part on output to determine how to reduce uncertainty in operations and/or measurements (e.g., sensor measurements). As mentioned, a digital twin may include positioning one or more sensors in the digital twin can compute values for such one or more sensors. As mentioned, where a sensor in an artificial lift system fails, a computed sensor of a digital twin may provide information that aims to compensate for the loss of the real sensor.

As mentioned, artificial lift can aim to move fluid in a downhole environment. As to an ESP, values for variables such as intake pressure and intake temperature may be available via sensors of the ESP. Fluid pumped by the ESP may include some amount of gas, for example, as a percentage of intake fluid (e.g., consider 10% to 30% gas). In such an example, a frequency analysis of intake pressure sensor data may be performed in a black box manner where the frequency spectrum may relate to a particular volume fraction of gas in pumped fluid (e.g., input a time series of pressure and output gas content). A method may also perform an inversion using one or more physical models where output of the inversion can be a value of gas content. In such an example, the outputs (e.g., black box and model inversion) can be compared where one of the outputs may be of a higher confidence (e.g., less uncertainty), which may be utilized to control the ESP (e.g., via a surface controller, etc.). In the foregoing example, the black box approach may provide better output as to gas content as the time scale of the frequency information may be too small for the one or more physical models to handle. Depending on operational circumstances, equipment, etc., one approach may provide better output than another approach and, for some scenarios, two approaches may provide outputs of substantially similar values (e.g., of similar confidence, quality, etc.). As an example, a combination of two outputs may allow for increased confidence (e.g., less uncertainty). While an ESP is mentioned, such an example may be applied to gas lift (e.g., operation of a gas valve in a mandrel, etc.) and/or a rod pump. In such examples, a gas valve may include a vibration sensor, a pressure sensor, etc., that may be able to sense time series data that can be analyzed for frequencies that may be indicative of gas behavior in fluid; whereas, for a rod pump, a load cell may provide variations in load with respect to time as time series data that can be analyzed for frequencies that may be indicative of gas behavior in fluid.

As an example, a system for using digital twins for model-based operation of electrical submersible pumps (ESPs) can include a plurality of digital twins corresponding to the plurality of physical ESPs where each respective digital twin includes: product nameplate data corresponding to a specific physical ESP, one or more simulation models, a database of time series data collected from sensors associated with the ESP; and a simulation platform configured to process the simulation models corresponding to the plurality of digital twins using a plurality of computer systems. In such an example, some simulation models in the plurality of digital twins may be calibrated using series sensor data and one or more parameter identification methods.

As an example, one or more simulation models may be calibrated in real or near real-time using one or more statistical or optimization methods.

As an example, a digital twin can include an associated web service interface configured to facilitate communication between the respective digital twin and one or more remote devices. In such an example, a system may further include a mobile device interface configured to facilitate monitoring of a plurality of remotely located physical machines via the plurality of digital twins.

As an example, a system can acquire time series sensor data from plurality of physical machines for purposes of generating a plurality of digital twins in real-time or near real-time.

As an example, a digital twin can include or be associated with a database configured to store time evolution of the digital twin as a model and installation and operational metadata associated with its corresponding physical artificial lift system.

As an example, some digital twin models may be utilized to develop off-line recommendations in response to various artificial lift system operational events that occur in a specific installation environment (e.g., a particular downhole environment).

As an example, some digital twin models may be used for on-line model-based control of an artificial lift system during response to operational events in its specific installation environment. As an example, reduced order models of a high fidelity digital twin model may be utilized for model-based control.

As an example, a historian framework may be utilized for purposes of optimizing one or more artificial lift system installations (e.g., utilizing one or more digital twins as may have been generated for one or more environments).

As an example, one or more digital twins may be utilized to optimize operation to extend remaining useful life (RUL) of an artificial lift system. As an example, one or more digital twins may be utilized to issue a failure warning of a specific artificial lift system. In such an example, a remote location may be notified regarding the failure warning (e.g., via one or more communication networks).

As to historical digital twins, one or more may be utilized in an equipment design process, an installation design process, and/or a parameter identification process.

FIG. 15 shows an example of a system 1510 and an example of a method 1580. As shown, the system 1510 includes a reception interface 1512 that can receive sensor data of an artificial lift system disposed at least in part in a well; an analysis engine 1520 that, based at least in part on a portion of the sensor data, can output values of state variables of the artificial lift system; and a transmitter interface 1514 that can transmit information, based at least in part on a portion of the values of state variables, to a surface controller operatively coupled to the artificial lift system.

In the example of FIG. 15, the reception and transmission interfaces 1512 and 1514 may be different interfaces or a common interface that is configured for reception and transmission of information. As an example, an interface can be a network interface, which may be wired and/or wireless. As an example, an interface may be a parallel interface and/or a serial interface. As an example, an interface or interfaces may be operatively coupled to acquisition and control equipment.

In the example of FIG. 15, the analysis engine 1520 includes a machine learning component 1522 that utilizes one or more mathematical networks to output at least a portion of the values of the state variables. For example, consider one or more artificial neural networks, etc., that can be trained as in machine learning to provide output based at least in part on sensed data. In the example of FIG. 15, the analysis engine 1520 includes an inversion component 1524 that utilizes a plurality of physical models to output at least a portion of the values of the state variables. For example, consider a joint inversion approach where a plurality of physical models are effectively linked (e.g., joined) in an inversion process that can provide output based at least in part on sensed data.

In the example of FIG. 15, the method 1580 includes a reception block 1582 for receiving sensor data of an artificial lift system disposed at least in part in a well during operation of the artificial lift system; an analysis block 1584 for analyzing at least a portion of the sensor data to output values of state variables of the artificial lift system; and a transmission block 1592 for transmitting information, based at least in part on a portion of the values of state variables, to a surface controller operatively coupled to the artificial lift system.

As shown in the example of FIG. 15, the analyzing can include machine learning per a learn block 1586 that utilizes one or more mathematical networks to output at least a portion of the values of the state variables and the analyzing can include inverting per an invert block 1588 that utilizes a plurality of physical models to output at least a portion of the values of the state variables.

As shown in FIG. 15, the method 1580 may be associated with various computer-readable storage media (CRM) blocks 1583, 1585, 1587, 1589 and 1593. Such blocks generally include instructions suitable for execution by one or more processors (or cores) to instruct a computing device or system to perform one or more actions. As an example, a single medium may be configured with instructions to allow for, at least in part, performance of various actions of the method 1580. A computer-readable storage medium (CRM) is non-transitory, not a signal and not a carrier wave.

As an example, a system can include a reception interface that receives sensor data of an artificial lift system disposed at least in part in a well; an analysis engine that, based at least in part on a portion of the sensor data, outputs values of state variables of the artificial lift system; and a transmitter interface that transmits information, based at least in part on a portion of the values of state variables, to a surface controller operatively coupled to the artificial lift system.

As an example, an analysis engine can include a machine learning component that utilizes one or more mathematical networks to output at least a portion of values of state variables and, for example, the analysis engine can include an inversion component that utilizes a plurality of physical models to output at least a portion of the values of the state variables.

As an example, sensor data can include values of a set of state variables where an analysis engine outputs values of state variables that include at least one state variable that is not in the set of state variables.

As an example, an analysis engine can generate a digital twin of an artificial lift system. In such an example, the analysis engine can update the digital twin during operation of the artificial lift system based at least in part on sensor data received during the operation of the artificial lift system. As an example, a digital twin can be a computerized avatar of the artificial lift system. As an example, a system can include a storage interface that stores the digital twin of the artificial lift system to a database (e.g., a data bus, a communication interface, etc.).

As an example, an analysis engine can include black box features and white box features. For example, black box features can include at least one artificial neural network (ANN) and white box features can include a plurality of physical models.

As an example, an artificial lift system can include an electric submersible pump, a rod pump and/or a gas lift valve.

As an example, a method can include receiving sensor data of an artificial lift system disposed at least in part in a well during operation of the artificial lift system; analyzing at least a portion of the sensor data to output values of state variables of the artificial lift system; and transmitting information, based at least in part on a portion of the values of state variables, to a surface controller operatively coupled to the artificial lift system. In such an example, the analyzing can include machine learning that utilizes one or more mathematical networks to output at least a portion of the values of the state variables and where the analyzing can include inverting that utilizes a plurality of physical models to output at least a portion of the values of the state variables.

As an example, one or more computer-readable storage media can include computer-executable instructions executable to instruct a computing system to: receive sensor data of an artificial lift system disposed at least in part in a well during operation of the artificial lift system; analyze at least a portion of the sensor data to output values of state variables of the artificial lift system; and transmit information, based at least in part on a portion of the values of state variables, to a surface controller operatively coupled to the artificial lift system. In such an example, the instructions to analyze can include instructions to perform machine learning that utilize one or more mathematical networks to output at least a portion of the values of the state variables and can include instructions to invert that utilize a plurality of physical models to output at least a portion of the values of the state variables.

As an example, one or more methods described herein may include associated computer-readable storage media (CRM) blocks. Such blocks can include instructions suitable for execution by one or more processors (or cores) to instruct a computing device or system to perform one or more actions. As an example, a computer-readable storage medium may be a storage device that is not a carrier wave (e.g., a non-transitory storage medium that is not a carrier wave).

FIG. 16 shows components of a computing system 1600 and a networked system 1610. The system 1600 includes one or more processors 1602, memory and/or storage components 1604, one or more input and/or output devices 1606 and a bus 1608. According to an embodiment, instructions may be stored in one or more computer-readable media (e.g., memory/storage components 1604). Such instructions may be read by one or more processors (e.g., the processor(s) 1602) via a communication bus (e.g., the bus 1608), which may be wired or wireless. The one or more processors may execute such instructions to implement (wholly or in part) one or more attributes (e.g., as part of a method). A user may view output from and interact with a process via an I/O device (e.g., the device 1606). According to an embodiment, a computer-readable medium may be a storage component such as a physical memory storage device, for example, a chip, a chip on a package, a memory card, etc.

According to an embodiment, components may be distributed, such as in the network system 1610. The network system 1610 includes components 1622-1, 1622-2, 1622-3, . . . , 1622-N. For example, the components 1622-1 may include the processor(s) 1602 while the component(s) 1622-3 may include memory accessible by the processor(s) 1602. Further, the component(s) 1622-2 may include an I/O device for display and optionally interaction with a method. The network may be or include the Internet, an intranet, a cellular network, a satellite network, etc.

Although only a few examples have been described in detail above, those skilled in the art will readily appreciate that many modifications are possible in the examples. Accordingly, all such modifications are intended to be included within the scope of this disclosure as defined in the following claims. In the claims, means-plus-function clauses are intended to cover the structures described herein as performing the recited function and not only structural equivalents, but also equivalent structures. Thus, although a nail and a screw may not be structural equivalents in that a nail employs a cylindrical surface to secure wooden parts together, whereas a screw employs a helical surface, in the environment of fastening wooden parts, a nail and a screw may be equivalent structures. It is the express intention of the applicant not to invoke 35 U.S.C. § 112, paragraph 6 for any limitations of any of the claims herein, except for those in which the claim expressly uses the words "means for" together with an associated function.

What is claimed is:

1. A system comprising:

a reception interface that receives sensor data of an artificial lift system disposed at least in part in a well, wherein the sensor data comprises one or more values of a set of state variables;

an analysis engine that, based at least in part on a portion of the sensor data, outputs one or more values of state variables of the artificial lift system, wherein the one or more outputted values of the state variables comprise one or more variables that is not in the set of state variables; and a transmitter interface that transmits information, based on the one or more of the values of the state variables of the artificial lift system, to a surface controller operatively coupled to the artificial lift system.

2. The system of claim 1 wherein the analysis engine comprises a machine learning component that utilizes one or more mathematical networks to output the one or more of the values of the state variables of the artificial lift system.

3. The system of claim 1 wherein the analysis engine comprises an inversion component that utilizes a plurality of physical models to output the one or more of the values of the state variables of the artificial lift system.

4. The system of claim 2 wherein the analysis engine comprises an inversion component that utilizes a plurality of physical models to output the one or more of the values of the state variables of the artificial lift system.

5. The system of claim 1 wherein the analysis engine generates a digital twin of the artificial lift system.

6. The system of claim 5 wherein the analysis engine updates the digital twin during operation of the artificial lift system based at least in part on sensor data received during the operation of the artificial lift system.

7. The system of claim 5 wherein the digital twin is a computerized avatar of the artificial lift system.

8. The system of claim 5 comprising a storage interface that stores the digital twin of the artificial lift system to a database.

9. The system of claim 1 wherein the analysis engine comprises black box features and white box features.

10. The system of claim 9 wherein the black box features comprise at least one artificial neural network (ANN).

11. The system of claim 9 wherein the white box features comprise a plurality of physical models.

12. The system of claim 1 wherein the artificial lift system comprises an electric submersible pump.

13. The system of claim 1 wherein the artificial lift system comprises a rod pump.

14. The system of claim 1 wherein the artificial lift system comprises a gas lift valve.

15. A method comprising:

receiving sensor data of an artificial lift system disposed at least in part in a well during operation of the artificial lift system, wherein the sensor data comprises one or more values of a set of state variables;

analyzing at least a portion of the sensor data to output one or more values of state variables of the artificial lift system that comprise one or more values of the state variables that is not in the set of the state variables; and transmitting information, based on the one or more of the values of the state variables of the artificial lift system, to a surface controller operatively coupled to the artificial lift system.

16. The method of claim 15 wherein the analyzing comprises machine learning that utilizes one or more mathematical networks to output the one or more of the values of the state variables of the artificial lift system and wherein the analyzing comprises inverting that utilizes a plurality of physical models to output the one or more of the values of the state variables of the artificial lift system.

17. One or more computer-readable storage media that comprise computer-executable instructions executable to instruct a computing system to:

receive sensor data of an artificial lift system disposed at least in part in a well during operation of the artificial lift system, wherein the sensor data comprises one or more values of a set of state variables;

analyze at least a portion of the sensor data to output one or more values of state variables of the artificial lift system that comprise one or more values of the state variables that is not in the set of the state variables; and transmit information, based on the one or more of the values of the state variables of the artificial lift system, to a surface controller operatively coupled to the artificial lift system.

18. The of one or more computer-readable storage media of claim 17 wherein the instructions to analyze comprise instructions to perform machine learning that utilize one or more mathematical networks to output the one or more of the values of the state variables of the artificial lift system and comprise instructions to invert that utilize a plurality of physical models to output the one or more of the values of the state variables of the artificial lift system.

* * * * *